US012486659B2

(12) United States Patent
Jiang

(10) Patent No.: US 12,486,659 B2
(45) Date of Patent: Dec. 2, 2025

(54) MOLDED PLASTIC STORAGE SHED STRUCTURE

(71) Applicant: Three Stone, LLC, San Jose, CA (US)

(72) Inventor: Jinglei Jiang, Yuyao (CN)

(73) Assignee: Three Stone, LLC, San Jose, CA (US)

( * ) Notice: Subject to any disclaimer, the term of this patent is extended or adjusted under 35 U.S.C. 154(b) by 351 days.

(21) Appl. No.: 18/362,826

(22) Filed: Jul. 31, 2023

(65) Prior Publication Data

US 2024/0035272 A1 Feb. 1, 2024

Related U.S. Application Data

(60) Provisional application No. 63/369,970, filed on Jul. 31, 2022.

(51) Int. Cl.
*E04B 1/343* (2006.01)
*E04B 1/61* (2006.01)

(52) U.S. Cl.
CPC ..... *E04B 1/34321* (2013.01); *E04B 1/34317* (2023.08); *E04B 1/34384* (2013.01); *E04B 1/6116* (2013.01); *E04B 1/6137* (2013.01); *E04B 1/6162* (2013.01); *E04B 2001/6195* (2013.01); *E04B 2103/04* (2013.01)

(58) Field of Classification Search
CPC ..... E04B 1/34321; E04B 1/34317; E04B 1/34384; E04B 1/6116; E04B 1/6137; E04B 1/6162; E04B 2001/6195; E04B 2103/04; E04B 1/12; E04B 1/6141; E04H 1/1205
See application file for complete search history.

(56) References Cited

U.S. PATENT DOCUMENTS

| | | | | |
|---|---|---|---|---|
| 5,357,728 | A * | 10/1994 | Duncanson | E04C 2/526 52/592.4 |
| 7,377,077 | B2 * | 5/2008 | Rebeck | E04H 1/1205 52/DIG. 14 |
| 8,707,631 | B2 * | 4/2014 | Scouten | E04H 9/14 52/68 |
| 10,697,171 | B2 * | 6/2020 | Melo Pereira | E04C 2/384 |
| 11,020,681 | B2 * | 6/2021 | Rieber | F16C 11/04 |
| 11,135,525 | B2 * | 10/2021 | Rieber | E04B 1/3445 |
| 11,274,431 | B2 * | 3/2022 | McCall | E04F 13/0871 |
| 11,927,008 | B2 * | 3/2024 | Giacomini | E04B 1/345 |
| 12,116,773 | B2 * | 10/2024 | Keller | E04C 2/46 |
| 12,291,859 | B2 * | 5/2025 | Keller | E04B 5/02 |
| 2003/0005660 | A1 * | 1/2003 | Stibolt | E04F 13/06 52/582.1 |
| 2005/0126083 | A1 * | 6/2005 | Rebeck | E04H 1/1205 52/79.1 |

(Continued)

*Primary Examiner* — Rodney Mintz
(74) *Attorney, Agent, or Firm* — Platinum Intellectual Property

(57) ABSTRACT

The present subject matter discloses an outdoor storage shed utilizing molded plastic components or panels. A storage shed structure can comprise foldable corner panels and one or more interlocked teeth couplings. The foldable corner panel can pivot at integrated folding grooves to serve as corners. The interlocked teeth couplings comprise a plurality of protrusions and matched recesses arranged on both sides of engaged panels. Furthermore, the storage shed can come with pre-constructed shelf grooves in the foldable corner panels. The storage shed can have a concaved door frame and a recessed door.

19 Claims, 39 Drawing Sheets

(56) References Cited

U.S. PATENT DOCUMENTS

| | | | | |
|---|---|---|---|---|
| 2008/0216426 | A1* | 9/2008 | Bunker | E04B 1/34315 52/285.3 |
| 2012/0180404 | A1* | 7/2012 | Scouten | E04H 9/028 52/79.5 |
| 2016/0138258 | A1* | 5/2016 | Schaffert | E04B 1/3445 52/79.5 |
| 2017/0051497 | A1* | 2/2017 | Kolbe | E04H 1/1205 |
| 2019/0055728 | A1* | 2/2019 | Melo Pereira | E04C 2/22 |
| 2019/0136506 | A1* | 5/2019 | McCall | E04C 2/365 |
| 2020/0049462 | A1* | 2/2020 | Jones | E04H 1/1205 |
| 2020/0215448 | A1* | 7/2020 | Rieber | A63H 33/008 |
| 2020/0215449 | A1* | 7/2020 | Rieber | E04B 1/345 |
| 2022/0127840 | A1* | 4/2022 | Giacomini | E04B 1/34384 |
| 2022/0298783 | A1* | 9/2022 | Shi | E04B 1/3445 |
| 2023/0061113 | A1* | 3/2023 | Keller | E04B 2/56 |
| 2023/0068992 | A1* | 3/2023 | Streeter | E04H 1/005 |
| 2023/0167636 | A1* | 6/2023 | Keller | E04B 1/14 52/91.3 |
| 2024/0035271 | A1* | 2/2024 | Jiang | E04B 1/6116 |
| 2025/0027314 | A1* | 1/2025 | Iin | E04H 1/1205 |
| 2025/0034891 | A1* | 1/2025 | Jiang | E04H 1/1205 |
| 2025/0163695 | A1* | 5/2025 | Rais-Rohani | E04B 1/3445 |

* cited by examiner

MOLDED PLASTIC STORAGE SHED STRUCTURE

CROSS-REFERENCES TO RELATED APPLICATIONS

This application claims the priority of Provisional Application No. 63/369,970, entitled "OUTDOOR STORAGE SHED," filed Jul. 31, 2022, which is incorporated herein by reference for all purposes.

TECHNICAL FIELD

The present subject matter is in the field of molded plastic assembly. More particularly, embodiments of the present subject matter relate to a storage shed comprising molded plastic panels.

BACKGROUND

Molded plastic has a wide variety of benefits as a furniture material and component. For example, it is highly resistant to impact, moisture, and chemicals, which makes it more durable compared to other materials like wood or glass; it is also lighter than many other materials, rendering it advantageous for transportation cost. Furthermore, molded plastics can be shaped into virtually any form, allowing for a great deal of design flexibility. This allows for more creative and complex designs than other materials. An example of such a design is an outdoor storage shed that is economical to manufacture, easy to transport and install while providing many novel and beneficial design features.

SUMMARY OF THE INVENTION

The present subject matter is directed to improved designs for an outdoor storage shed utilizing molded plastic components or panels. Embodiments of the present subject matter are discussed below with reference to FIGS. 1-35.

In the following description, for purposes of explanation, numerous specific details are set forth in order to provide a thorough understanding of the present subject matter. It will be apparent, however, to one skilled in the art that the present subject matter may be practiced without some of these specific details. In addition, the following description provides examples, and the accompanying drawings show various examples for the purposes of illustration. Moreover, these examples should not be construed in a limiting sense as they are merely intended to provide examples of embodiments of the subject matter rather than to provide an exhaustive list of all possible implementations. In other instances, well-known structures and devices are shown in block diagram form in order to avoid obscuring the details of the disclosed features of various described embodiments.

According to some embodiments, the present subject matter is directed to a storage shed structure made of molded plastic panels, the shed structure comprises: a floor, side walls coupled with the floor, the side walls further comprise: a plurality of flat panels, a plurality of foldable corner panels that form four corners of the storage shed structure, wherein the plurality of flat panels are coupled to the plurality of corner panels via at least one or more interlocked teeth couplings. The storage shed further comprises one or more doors coupled with the side walls and the floor, and a roof that comprises a plurality of roof panels.

According to some embodiments, the interlocked teeth couplings comprise a plurality of protrusions and matched recesses arranged on both the plurality of foldable corner panels and the plurality of flat panels, wherein the plastic material has varied depth based on the design of the interlocked teeth couplings.

According to some embodiments, each foldable corner panel has an embedded folding groove that divides a molded plastic panel into a first leaf and a second leaf, wherein the embedded folding groove has thinner plastic material that enables the foldable corner panel to fold at a fixed angle when the foldable molded plastic panel is installed. According to some embodiments, a foldable corner panel can have a second embedded folding groove with thinner less plastic material.

According to some embodiments, the storage shed can further have a first coupling structure arranged on a first leaf, and a second coupling structure arranged on a second leaf, wherein the first coupling structure is different from the second coupling structure. The first coupling structure can comprise a slider and the second coupling structure comprises one or more clip slots.

According to some embodiments, the storage shed can further have a plurality of shelf grooves embedded into the interior surfaces of the foldable molded plastic panels and one or more shelves configured to insert into the plurality of shelf grooves to provide storage and to enhance the stability of the storage shed structure.

According to some embodiments, the molded plastic panels comprise a number of back strengthening ribs that comprise vertical support grooves and horizontal support grooves, and wherein each vertical support groove is surrounded by a plurality of horizontal support grooves.

According to some embodiments, the storage shed can further have a concave door frame transition within a foldable corner panel, wherein the concave door frame is sloped towards a door.

According to some embodiments, the storage shed can further have a plurality of supporting beams that are stored within embedded lots in the back of the molded plastic panels during transportation, wherein a depth of the embedded slots is smaller than a depth of the supporting beams.

According to some embodiments, the present subject matter is directed to a storage shed structure made of molded plastic panels, the shed structure comprises: side walls coupled with the floor, the side walls further comprise: a plurality of flat panels, a plurality of corner panels that form four corners of the storage shed structure, wherein the plurality of flat panels are coupled to the plurality of corner panels via at least one or more interlocked teeth couplings, and a concave door frame transition within a corner panel, wherein the concave door frame is sloped towards a door.

According to some embodiments, the interlocked teeth couplings comprise a plurality of protrusions and matched recesses arranged on both the plurality of foldable corner panels and the plurality of flat panels, wherein the plastic material has varied depth based on the design of the interlocked teeth couplings.

According to some embodiments, the storage shed can further have a plurality of shelf grooves embedded into interior surfaces of the foldable molded plastic panels. According to some embodiments, the storage shed can further have one or more shelves configured to insert into the plurality of shelf grooves to provide storage and to enhance the stability of the storage shed structure.

According to some embodiments, the molded plastic panels comprise a number of back strengthening ribs that comprise vertical support grooves and horizontal support grooves, and wherein each vertical support groove is surrounded by a plurality of horizontal support grooves.

According to some embodiments, the storage shed can further have a concave door frame transition within a foldable corner panel, wherein the concave door frame is sloped towards a door. Furthermore, a plurality of supporting beams that are stored within embedded lots in the back of the molded plastic panels during transportation, wherein a depth of the embedded slots is smaller than a depth of the supporting beams.

According to some embodiments, the present subject matter is directed to a storage shed structure made of molded plastic panels, the shed structure comprises: side walls, the side walls further comprise: a plurality of flat panels, a plurality of foldable corner panels that form four corners of the storage shed structure, a concave door frame transitions within a foldable corner panel, wherein the concave door frame is sloped towards a door coupled with the side walls and the floor, and a roof that comprises a plurality of foldable roof panels.

According to some embodiments, the present subject matter is directed to a storage shed structure made of molded plastic panels, the shed structure comprises: a floor further comprises a plurality of corner edge floor panels, and a plurality of transitional floor panels coupled to the plurality of corner edge floor panels via one or more connectors. It further has side walls coupled with the floor, the side walls further comprise: a plurality of flat panels, a plurality of foldable corner panels that form four corners of the storage shed structure. The storage shed structure further comprises one or more doors coupled with the side walls and the floor, and a roof that comprises a plurality of foldable roof panels. According to some embodiments, the shed further comprises a lintel installed between the roof and the side walls, wherein the lintel comprises one or foldable lintel panels.

According to some embodiments, each of the molded plastic panels has similar size and shape to reduce package space and transportation cost. Also, the one or more connectors comprise at least a butterfly connector and a cross/double-butterfly connector.

According to some embodiments, each foldable corner panel has an embedded folding groove that has thinner plastic material, and wherein the embedded folding groove enables each foldable corner panel to fold at a fixed angle when the storage shed structure is installed. The embedded folding groove can enable each corner edge floor panel and each foldable corner panel to lay flat during transportation.

According to some embodiments, the molded plastic panels comprise a number of back strengthening ribs that comprise vertical support grooves and horizontal support grooves, and wherein each vertical support groove is surrounded by a plurality of horizontal support grooves.

According to some embodiments, each corner edge floor panel has two sides to connect to wall panels and each transitional floor panel has one side to connect to the wall panels.

According to some embodiments, at least one side of the corner edge floor has more than one coupling mechanism. According to some embodiments, a first side of a transitional floor panel has a first slider rail, a first side of a corner edge floor panel has a second slider rail configured to be in continuation with the first slider rail, and wherein the first side of the corner edge floor panel further has one or more clips. According to some embodiments, the first slider rail comprises one of a L-shaped groove and a T-shaped groove, or another type of groove.

According to some embodiments, the first slider rail of the transitional floor panel and the second slider rail of the corner edge floor panel are configured to engage with a first slider of a wall panel, and wherein the one or more clips of the corner edge floor panel are configured to engage one or more clip slots on the wall panel.

According to some embodiments, the plurality of foldable corner panels are connected to the plurality of flat panels via interlocked teeth couplings. The interlocked teeth couplings comprise a plurality of protrusions and matched recesses arranged on both the plurality of foldable corner panels and the plurality of flat panels, wherein the plastic material has varied depth based on the design of the interlocked teeth couplings.

According to some embodiments, the plurality of transitional floor panels and the plurality of flat panels of the side walls are extendable. According to some embodiments, a concave door frame can transition within a foldable corner panel, wherein the concave door frame is sloped towards a door.

According to some embodiments, the present subject matter is directed to a foldable molded plastic panel that comprises an embedded folding groove that divides a molded plastic panel into a first leaf and a second leaf, wherein the embedded folding groove has thinner plastic material that enables the molded plastic panel to fold at a fixed angle when the foldable molded plastic panel is installed, wherein the foldable molded plastic model unfolds and forms a flat surface prior to the installation, and wherein the foldable molded plastic model functions as a corner for a molded plastic structure after the installation.

According to some embodiments, the foldable molded plastic panel further comprises a first coupling structure arranged on a first leaf, and a second coupling structure arranged on a second leaf, wherein the first coupling structure is different from the second coupling structure. Furthermore, the first coupling structure can comprise a slider and the second coupling structure comprises one or more clip slots.

According to some embodiments, the foldable molded plastic panel further comprises a plurality of shelf grooves embedded into interior surfaces of the foldable molded plastic panel. According to some embodiments, one or more shelves can be slotted into the plurality of shelf grooves to provide storage and to enhance the stability of the storage shed structure.

According to some embodiments, the foldable molded plastic panel further comprises a number of back strengthening ribs that comprise vertical support grooves and horizontal support grooves, and wherein each vertical support groove is surrounded by a plurality of horizontal support grooves.

According to some embodiments, the foldable molded plastic panel further comprises a first plurality of interlocked teeth couplings arranged at a first edge of the foldable molded plastic panel, wherein the first plurality of interlocked teeth couplings are configured to engage a second plurality of interlocked teeth couplings of another molded plastic panel. Furthermore, the first plurality of interlocked teeth couplings and the second plurality of interlocked teeth couplings can be further secured by an additional fixing mechanism.

According to some embodiments, the present subject matter is directed to a storage shed structure made of molded plastic panels. It comprises a floor further that further comprises a plurality of corner edge floor panels, and a plurality of transitional floor panels coupled to the plurality of corner edge floor panels via one or more connectors. The shed structure further comprises side walls coupled with the floor, the side walls further comprise a plurality of flat panels, a plurality of foldable corner panels that form four corners of the storage shed structure, a plurality of shelf grooves embedded into the interior surface of corner panels, and one or more shelves configured to insert into the plurality of shelf grooves to provide storage and to enhance the stability of the storage shed structure. Furthermore, the storage shed structure can consist of one or more doors coupled with the side walls and the floor, and a roof that comprises a plurality of foldable roof panels.

Other aspects and advantages of the present subject matter will become apparent from the following detailed description taken in conjunction with the accompanying drawings, which illustrate, by way of example, the principles of the present subject matter.

DESCRIPTION OF DRAWINGS

The present subject matter will be further described in detail below with reference to the embodiments of the accompanying drawings.

DETAILED DESCRIPTION

It is to be understood that even though numerous characteristics and advantages of various embodiments of the present subject matter have been set forth in the foregoing description, together with details of the structure and function of various embodiments of the subject matter, this disclosure is illustrative only. In some cases, certain subassemblies are only described in detail with one such embodiment. Nevertheless, it is recognized and intended that such subassemblies may be used in other embodiments of the subject matter. Practitioners skilled in the art will recognize many modifications and variations. Changes may be made in detail, especially matters of structure and management of parts within the principles of the embodiments of the present subject matter to the full extent indicated by the broad general meaning of the terms in which the appended claims are expressed.

Having disclosed exemplary embodiments and the best mode, modifications and variations may be made to the disclosed embodiments while remaining within the scope of the embodiments of the subject matter as defined by the following claims.

Figure 1:
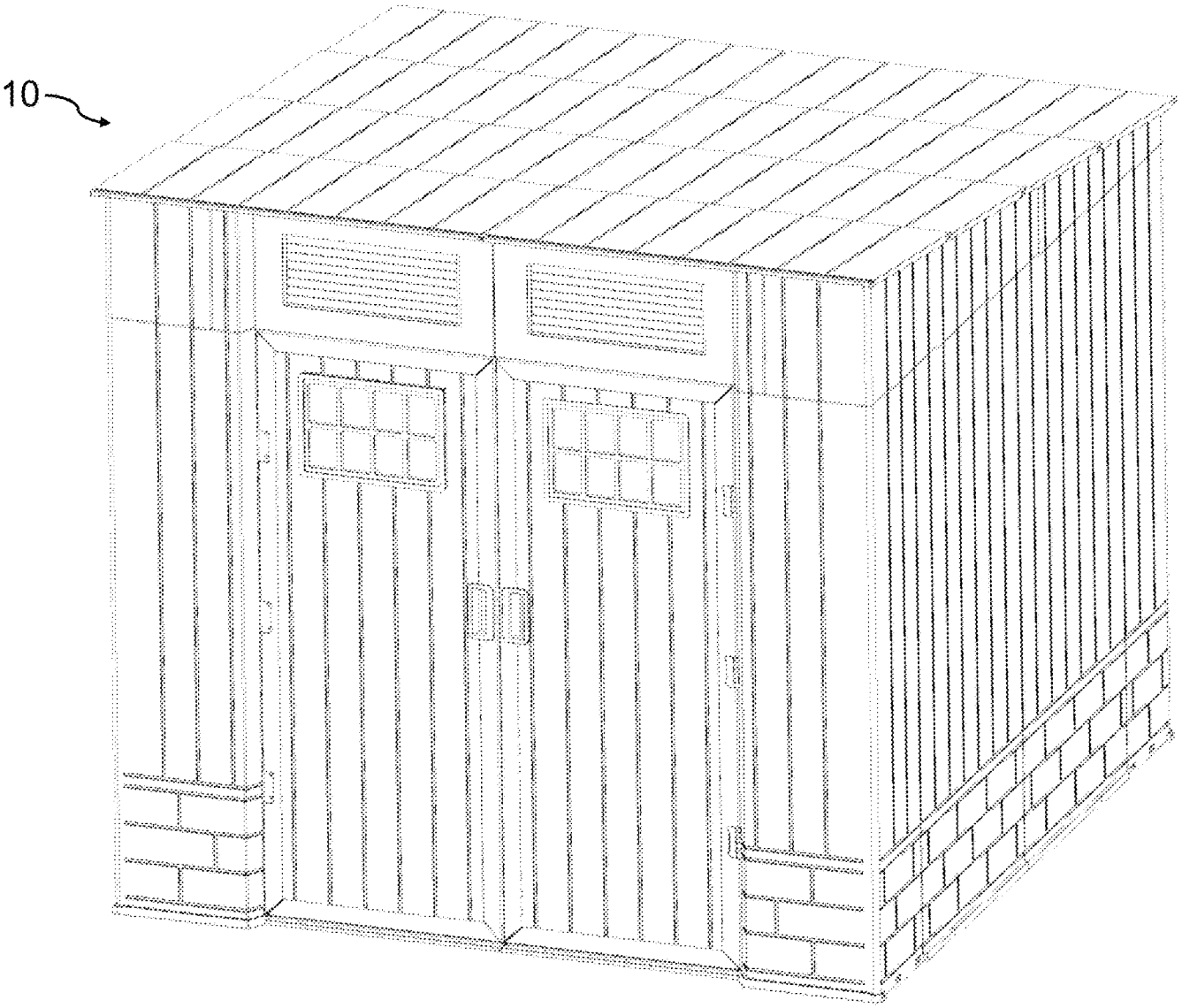
FIG. 1 is a perspective view of an embodiment of the present subject matter with the front door closed.
Figure 2:
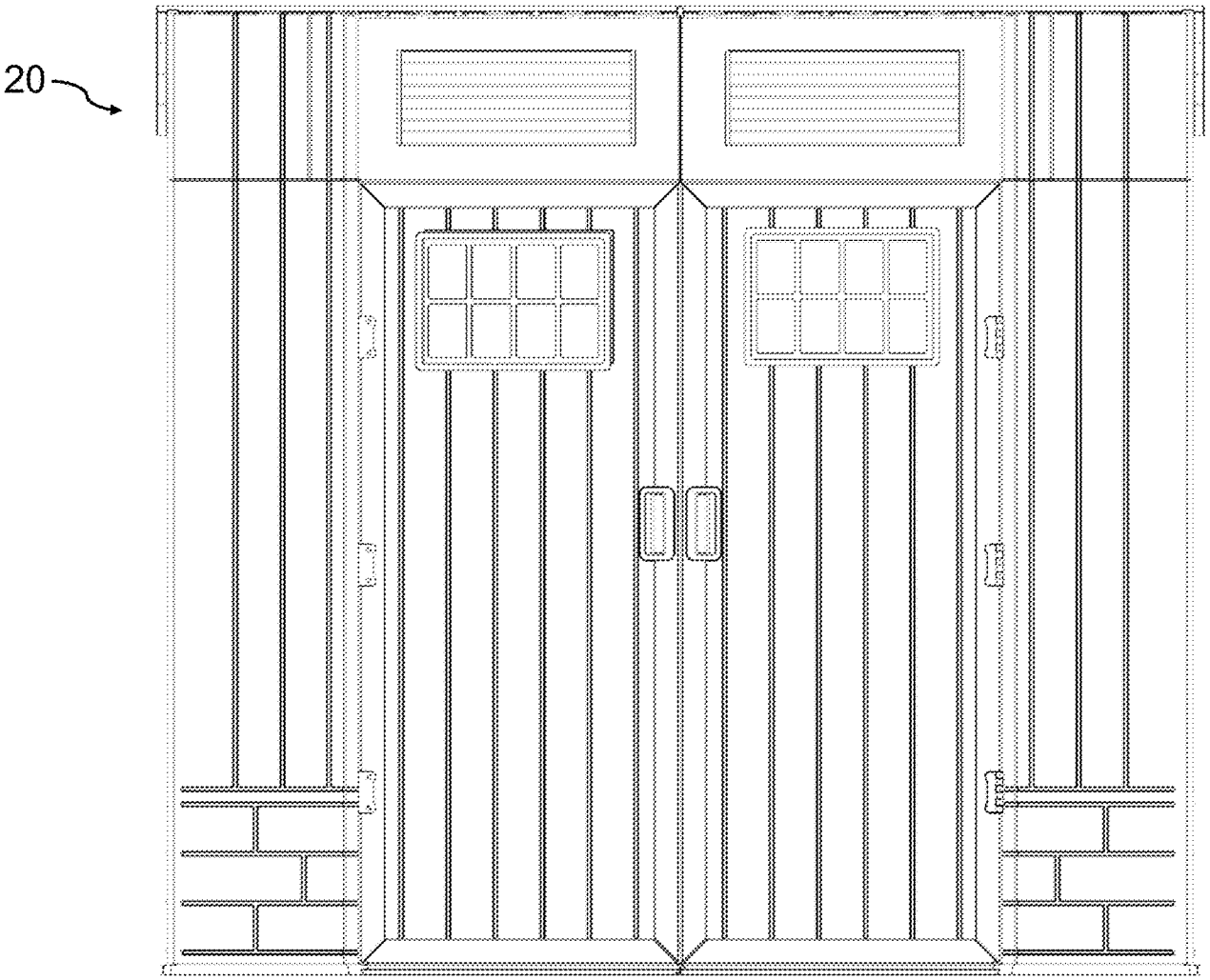
FIG. 2 is a front view of an embodiment of the present subject matter.
Figure 3:
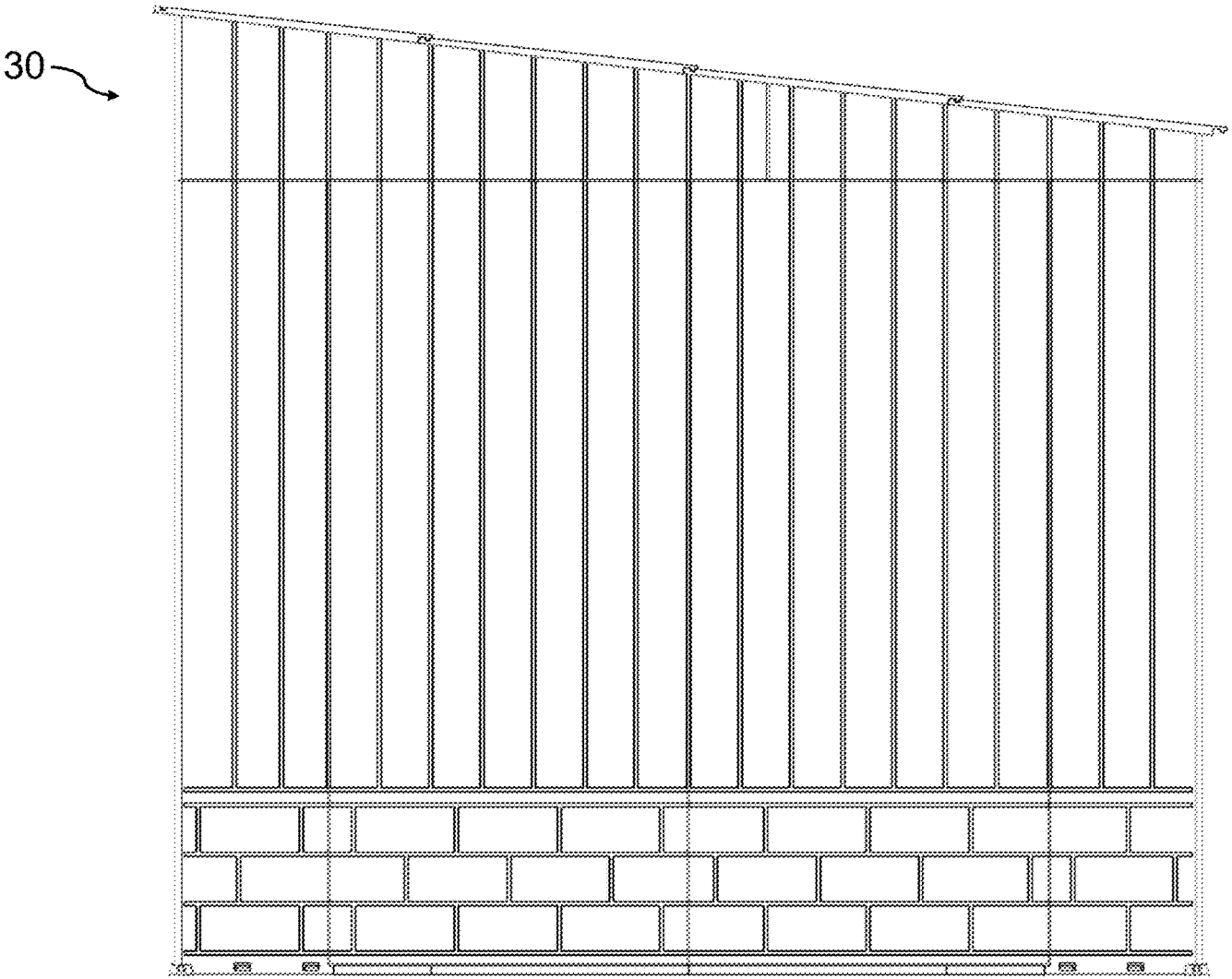
FIG. 3 is a first side view of an embodiment of the present subject matter.
Figure 4:
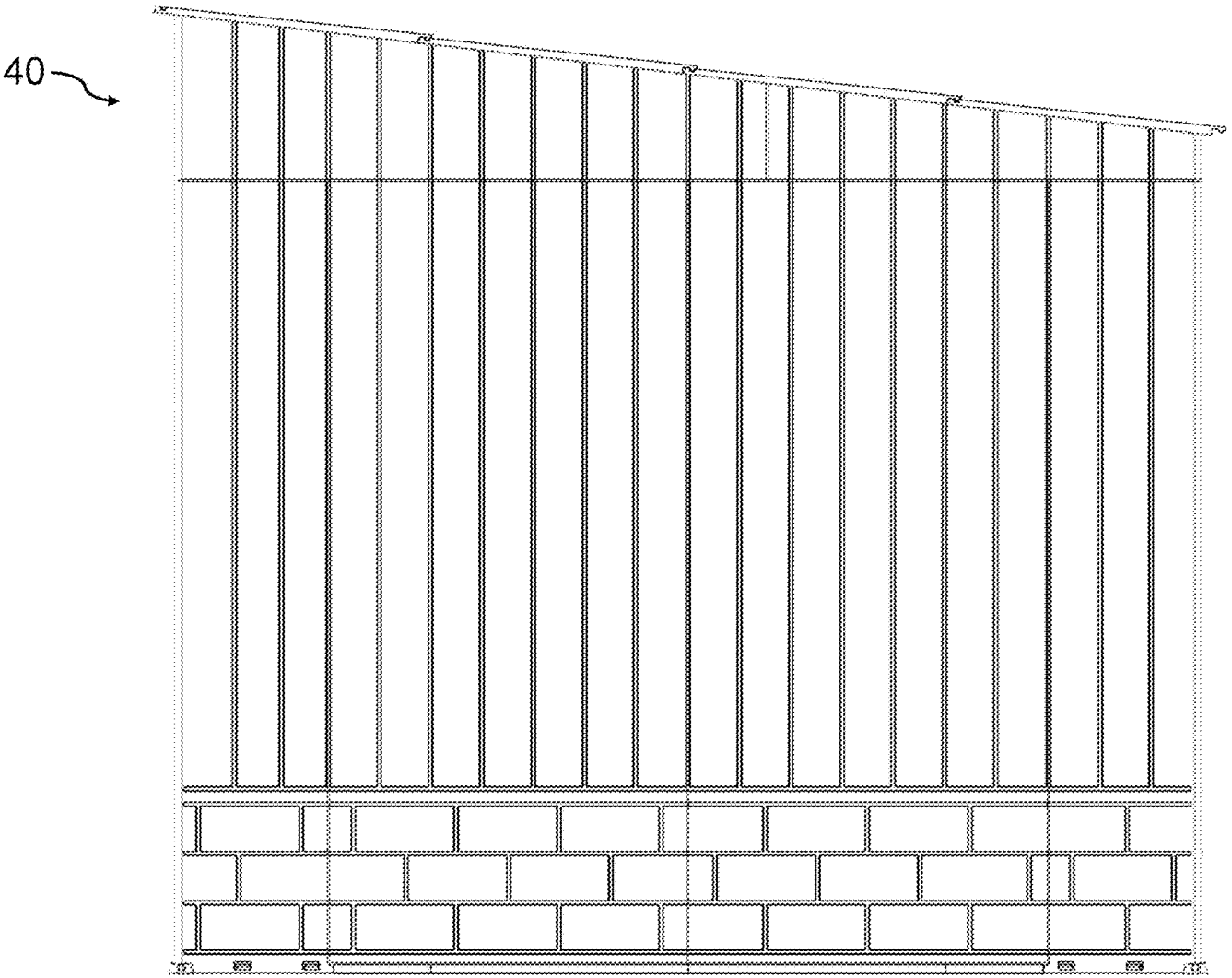
FIG. 4 is a second side view of an embodiment of the present subject matter.
Figure 5:
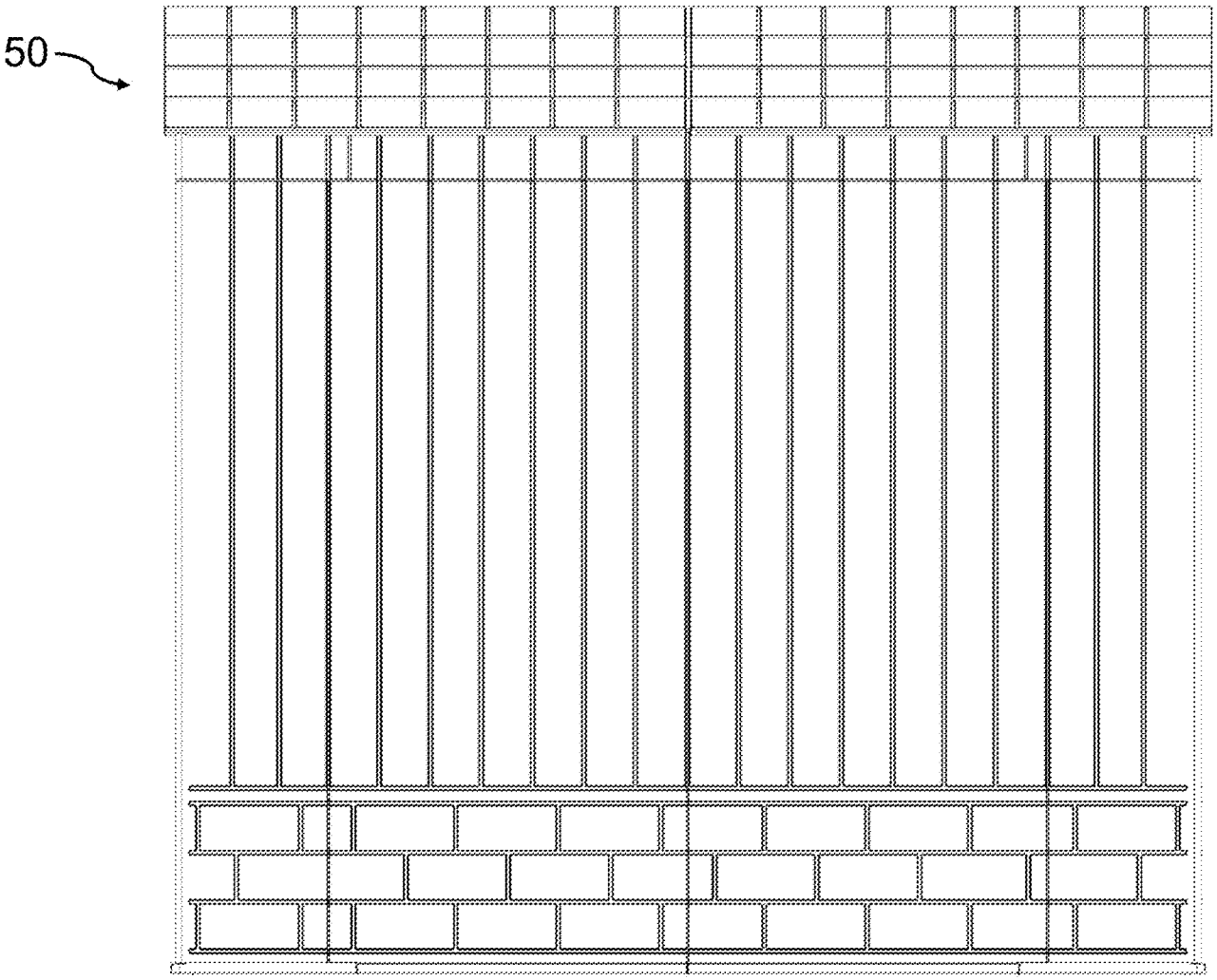
FIG. 5 is a rear view of an embodiment of the present subject matter.
Figure 6:
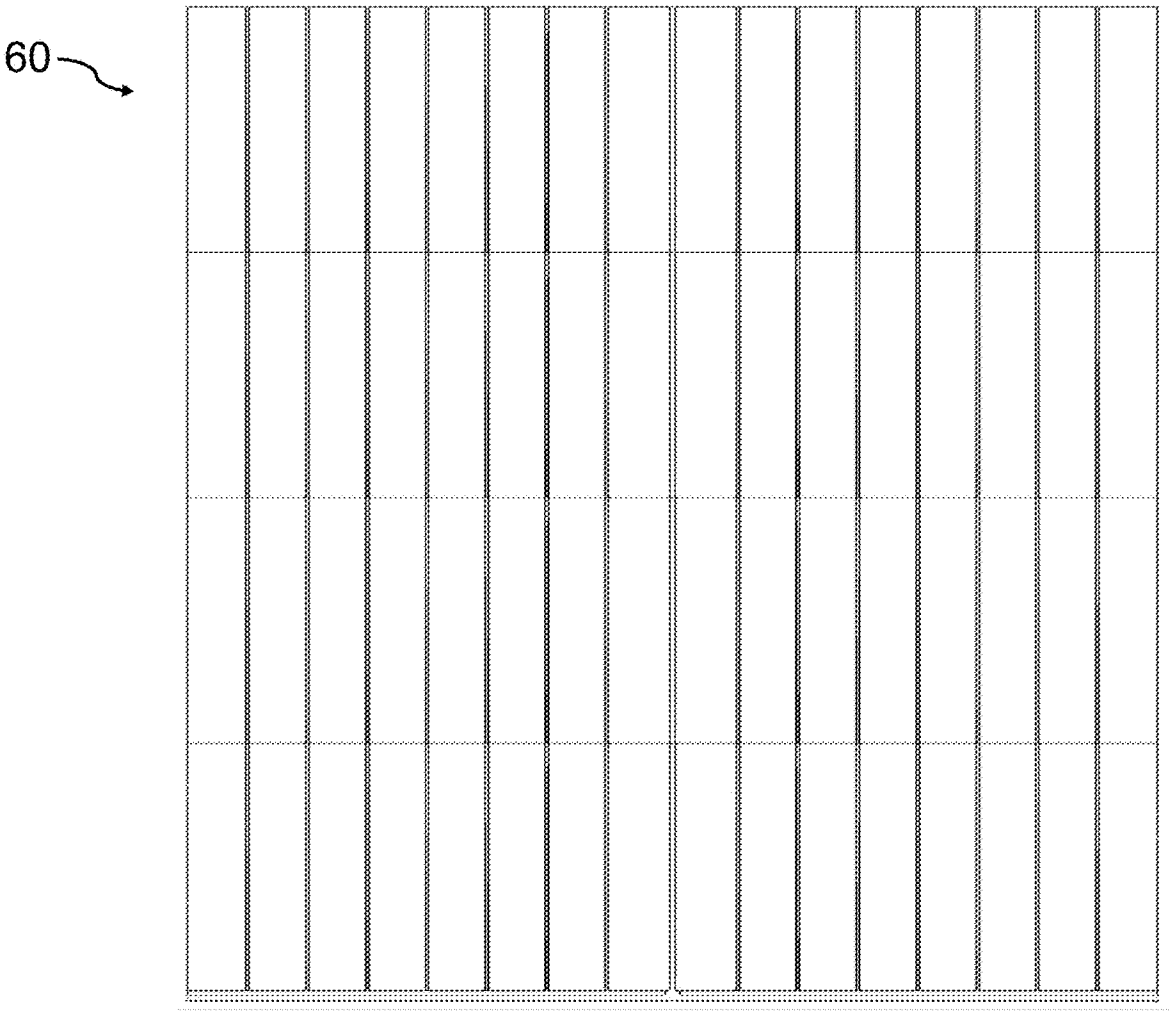
FIG. 6 is a top plan view of an embodiment of the present subject matter.

FIG. 1 is a perspective view 10 of an outdoor storage shed. The outdoor storage shed 10 can be made of molded plastic components that are durable and versatile. The plastic panels can be configured and manufactured in a substantially similar shape and size. This way, the package of the panels is more compact, resulting in reduced transportation cost. FIG. 2 is a front view 20 of an outdoor storage shed. FIG. 3 is a first side view 30 of an outdoor storage shed. FIG. 4 is a second side view 40 of an outdoor storage shed. FIG. 5 is a rear view 50 of an outdoor storage shed. FIG. 6 is a top view 60 of an outdoor storage shed.

Figure 7:
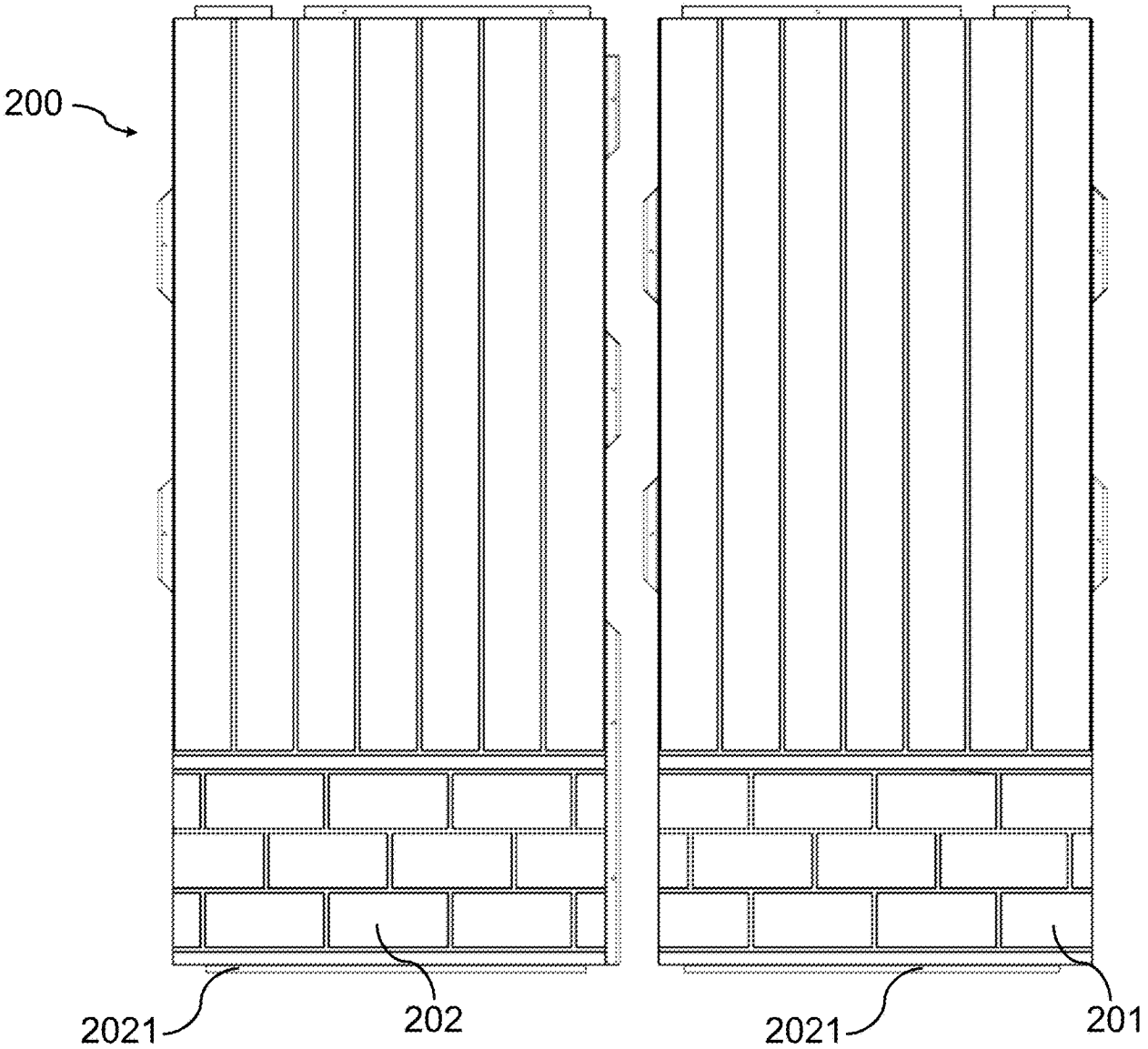
FIG. 7 shows a front view of flat wall panels, according to an embodiment of the present subject matter.

FIG. 7 shows a front view of flat wall panels, according to an embodiment of the present subject matter. According to some embodiments, the outdoor storage shed's side walls can consist of both flat panels and foldable corner panels, which can form the shed structure's four corners. Alternatively, according to some embodiments, the shed's side walls can include only foldable corner panels, thereby omitting any flat panels. As depicted in FIG. 7, the flat panel 200 may include a basic flat panel 201, which has symmetrical interlocking teeth or portions on both sides. There is also an extension flat panel 202 that can be optional and can be used for enlarging the storage shed. A slider rail 2021 for coupling with one or more floor panels can be arranged on the bottom side of the basic flat panel 201 and the extension flat panel 202.

Figure 8:
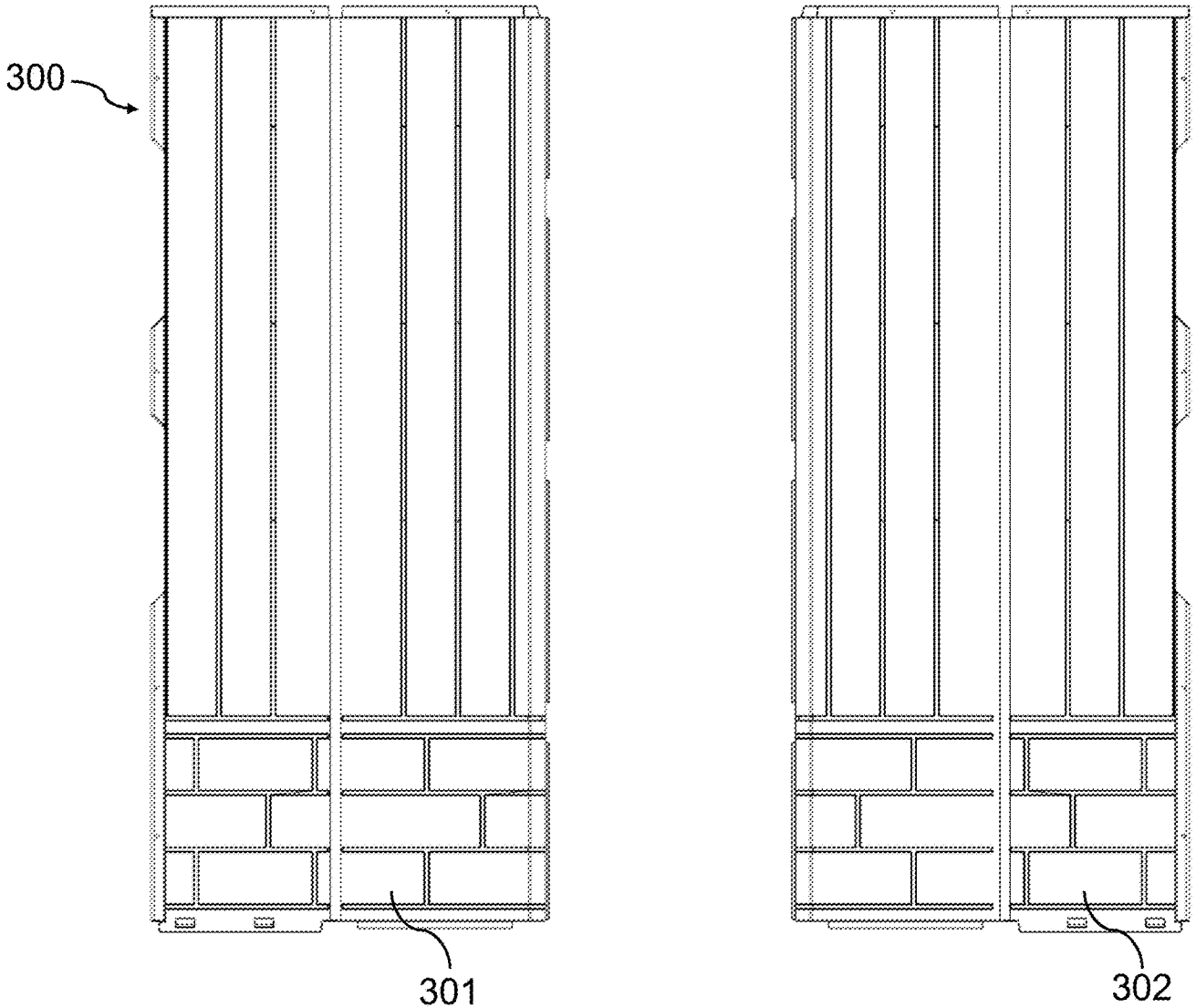
FIG. 8 shows foldable corner panels, according to an embodiment of the present subject matter.

FIG. 8 shows foldable corner panels, according to an embodiment of the present subject matter. According to some embodiments, wall panels can consist of foldable corner panels 300. Examples shown in this drawing include first foldable corner panel 301 for the front right corner of the shed and second foldable corner panel 302 for the left right corner, which constitute mirror images to each other.

In the traditional design of a storage shed, the corner assembly can consist of two separate panels held together by fasteners, creating a seamed connection that could lead to instability. Additionally, this joint or seam allows water and rain to enter the shed, causing potential damage. However, these issues are resolved with the present foldable corner panel, which can eliminate the need for a joint between two panels.

The foldable corner panel can comprise a folding groove that divides it into a first leaf and a second leaf. Both leaves of the foldable panel have sizes and shapes similar to other wall and floor panels used in the shed. To achieve this, the folding groove can be created by injecting a lesser amount of plastic material or using thinner plastic compared to the rest of the panel. This process results in a flexible and turnable soft area that allows the leaves to pivot without the need for additional fasteners or seams.

During transportation, the two leaves are folded and closed at the groove. Prior to the installation, the foldable molded plastic model can unfold and form a flat surface. During installation, the two leaf panels of the foldable panel can be fixed at a fixed angle, e.g., 90°, to constitute a seamless corner. According to some embodiments, depending on the intended use of the final product, the two leaf panels can form a corner at other angles, such as 60°. According to some embodiments, multiple folding grooves can be embedded into a single panel to create multiple turning areas. Furthermore, the one-piece foldable corner can reduce manufacturing cost and also reduce installation complexity and time for the user.

Figure 9:
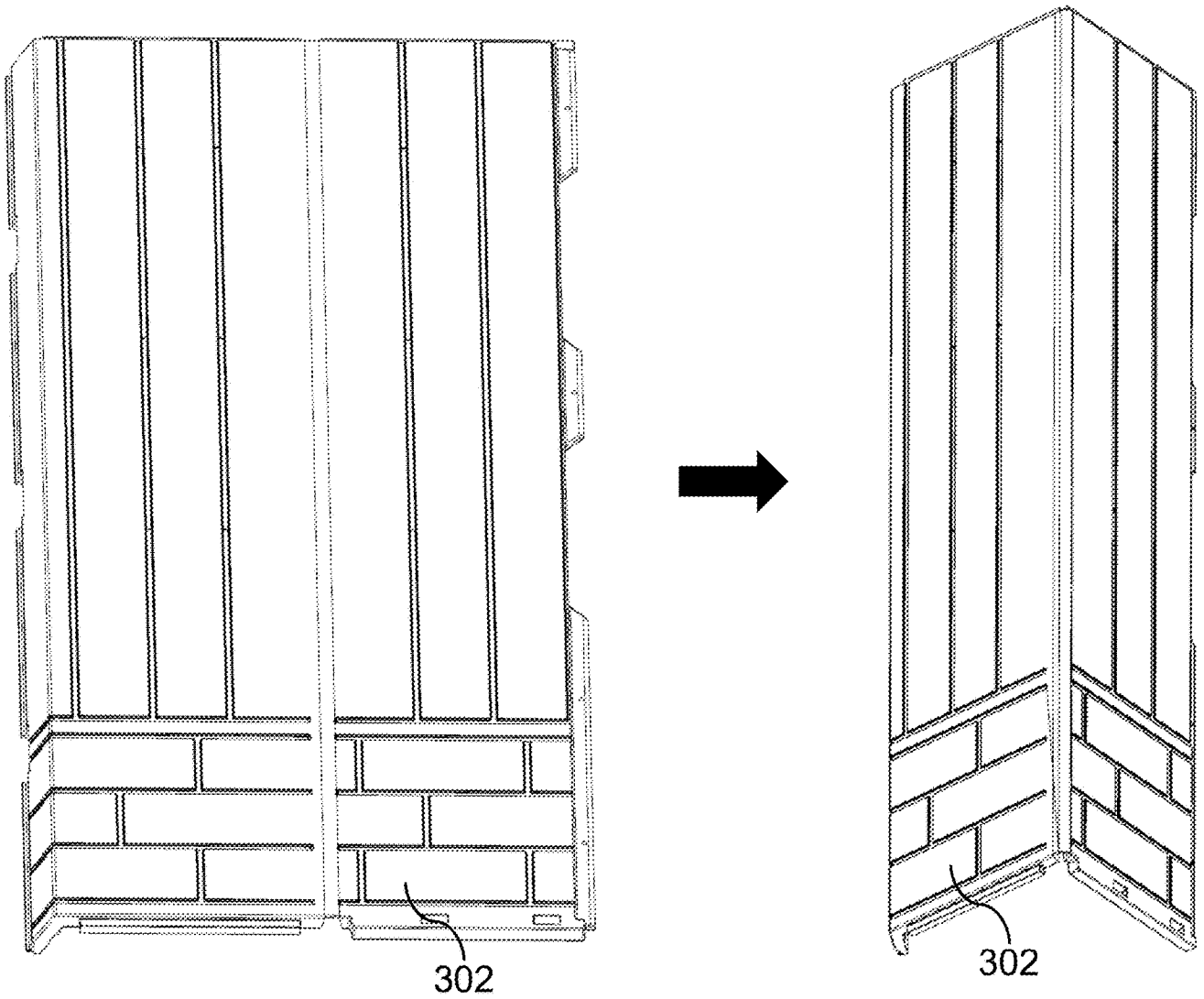
FIG. 9 shows a front view of a foldable corner panel, according to an embodiment of the present subject matter.
Figure 10:
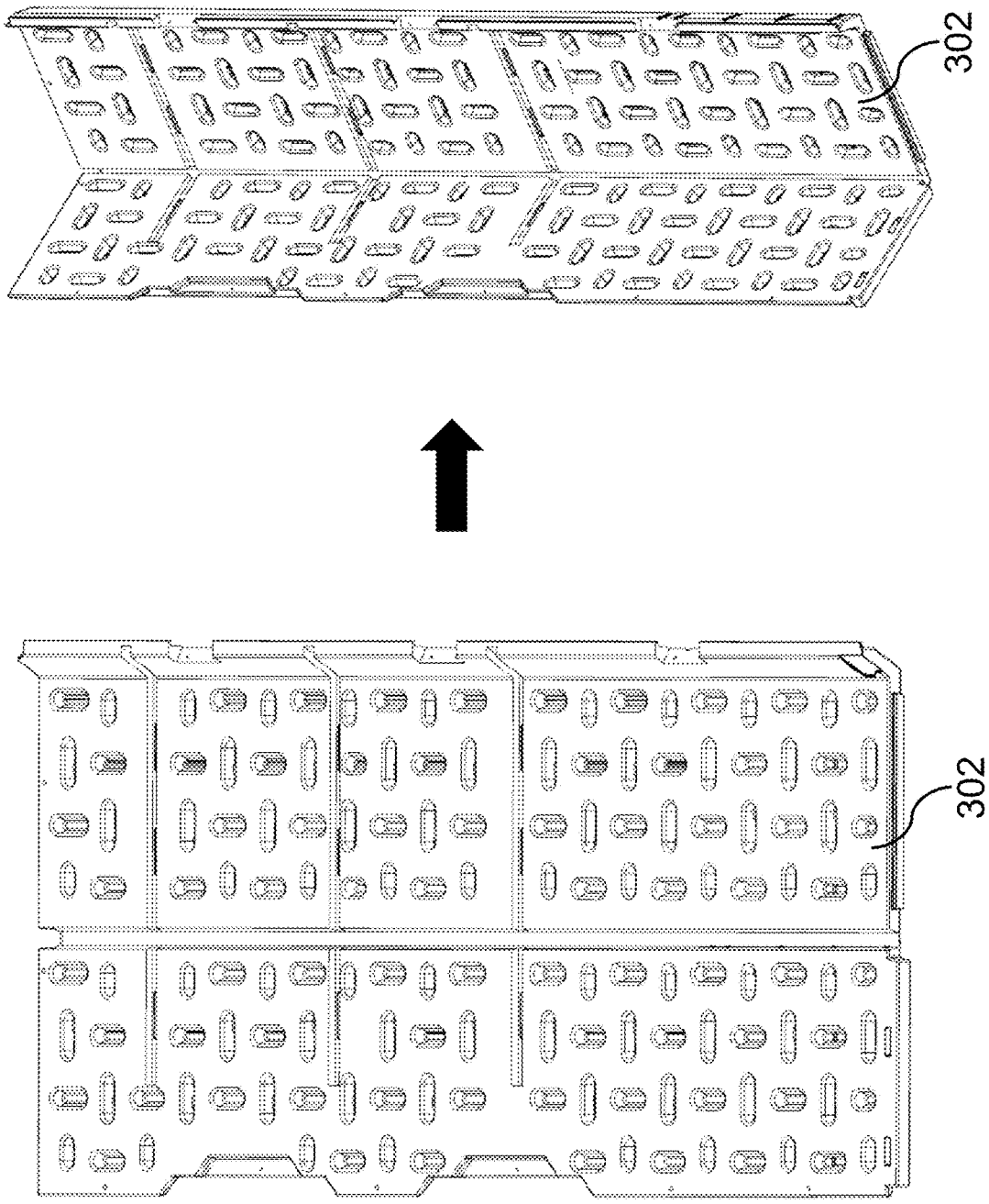
FIG. 10 shows a rear view of a foldable corner panel, according to an embodiment of the present subject matter.

FIG. 9 shows a front view of a foldable corner panel, according to an embodiment of the present subject matter. FIG. 10 shows a rear view of a foldable corner panel, according to an embodiment of the present subject matter. As shown in FIG. 9, a second foldable corner panel 302 can be unfolded at the folding groove and form a flat surface prior to the installation. After the installation, the foldable panel can be affixed to the corner edge floor panels to form a corner. A similar process is shown in FIG. 10 from the rear view.

Figure 11:
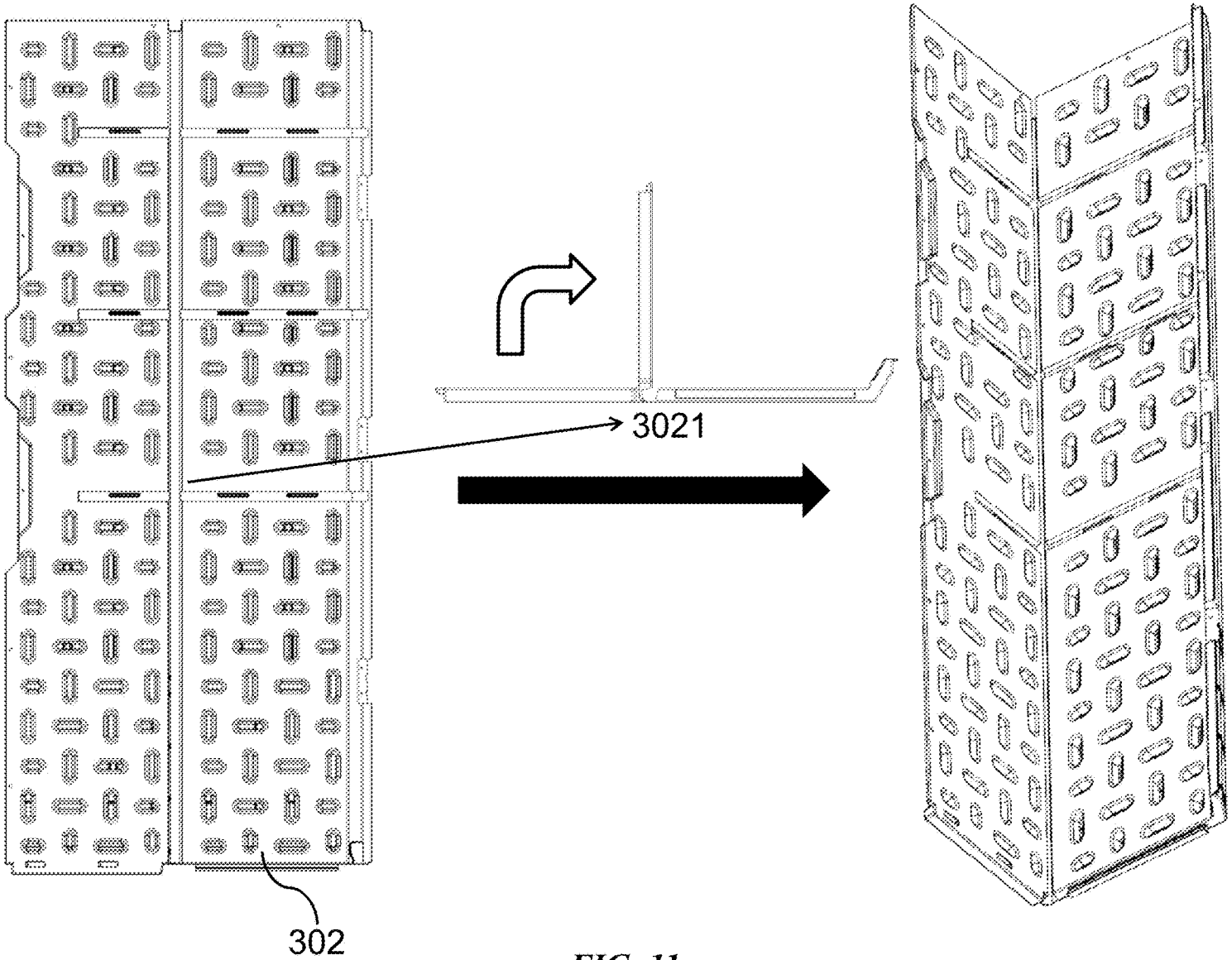
FIG. 11 shows another rear view of a foldable corner panel, according to an embodiment of the present subject matter.

FIG. 11 shows another rear view of a foldable corner panel, according to an embodiment of the present subject matter. As shown in this drawing, a folding groove 3021 can enable the turning of a foldable corner panel, e.g. second foldable corner panel 302.

Figure 12:
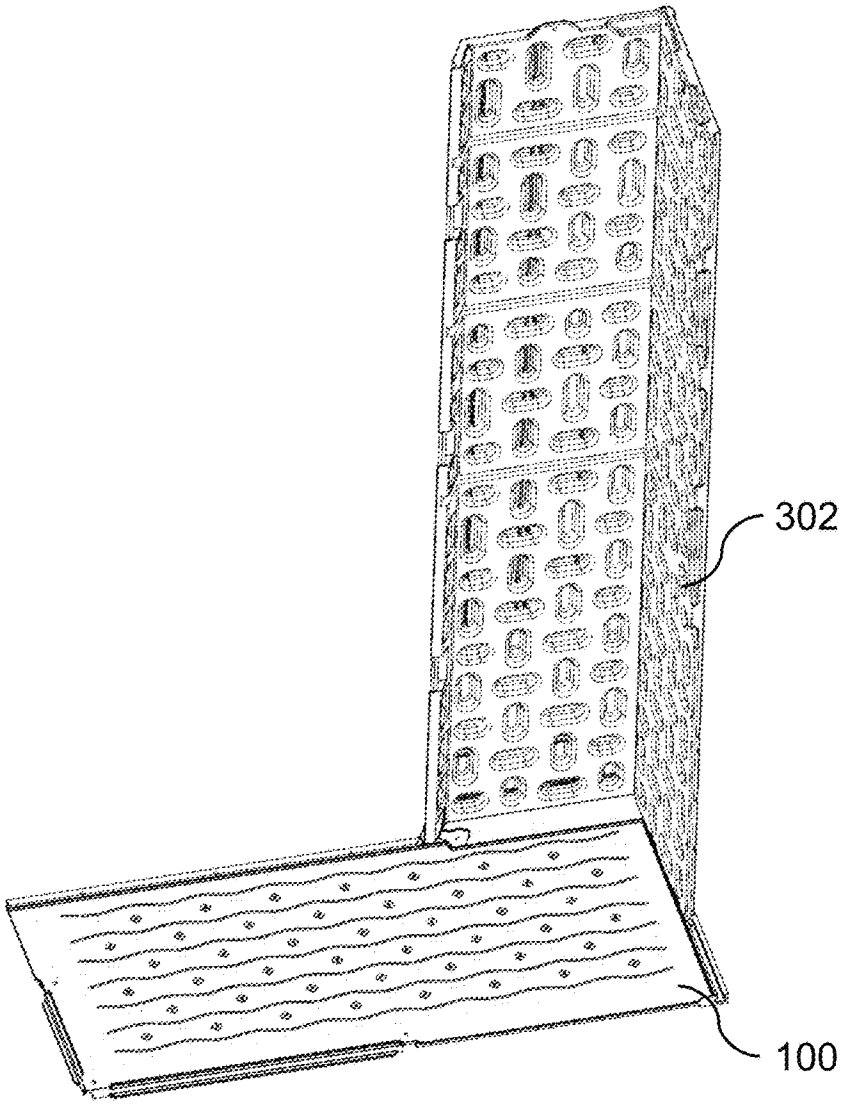
FIG. 12 shows a foldable corner panel coupled to a floor panel, according to an embodiment of the present subject matter.

FIG. 12 shows a foldable corner panel coupled to a floor panel, according to an embodiment of the present subject matter. After installation, second foldable corner panel 302 can be fixed along two edges of floor 100. According to some embodiments, floor 100 can be a corner edge floor panel that comprises two types of coupling mechanisms, e.g., a slider coupling and a clip coupling, on each edged side. According to some embodiments, seam lines between side wall panels can offset with seam lines between floor panels, which means avoiding aligning two seam lines substantially. This way, the connected floor panels and the wall panels can reinforce each other.

Figure 13:
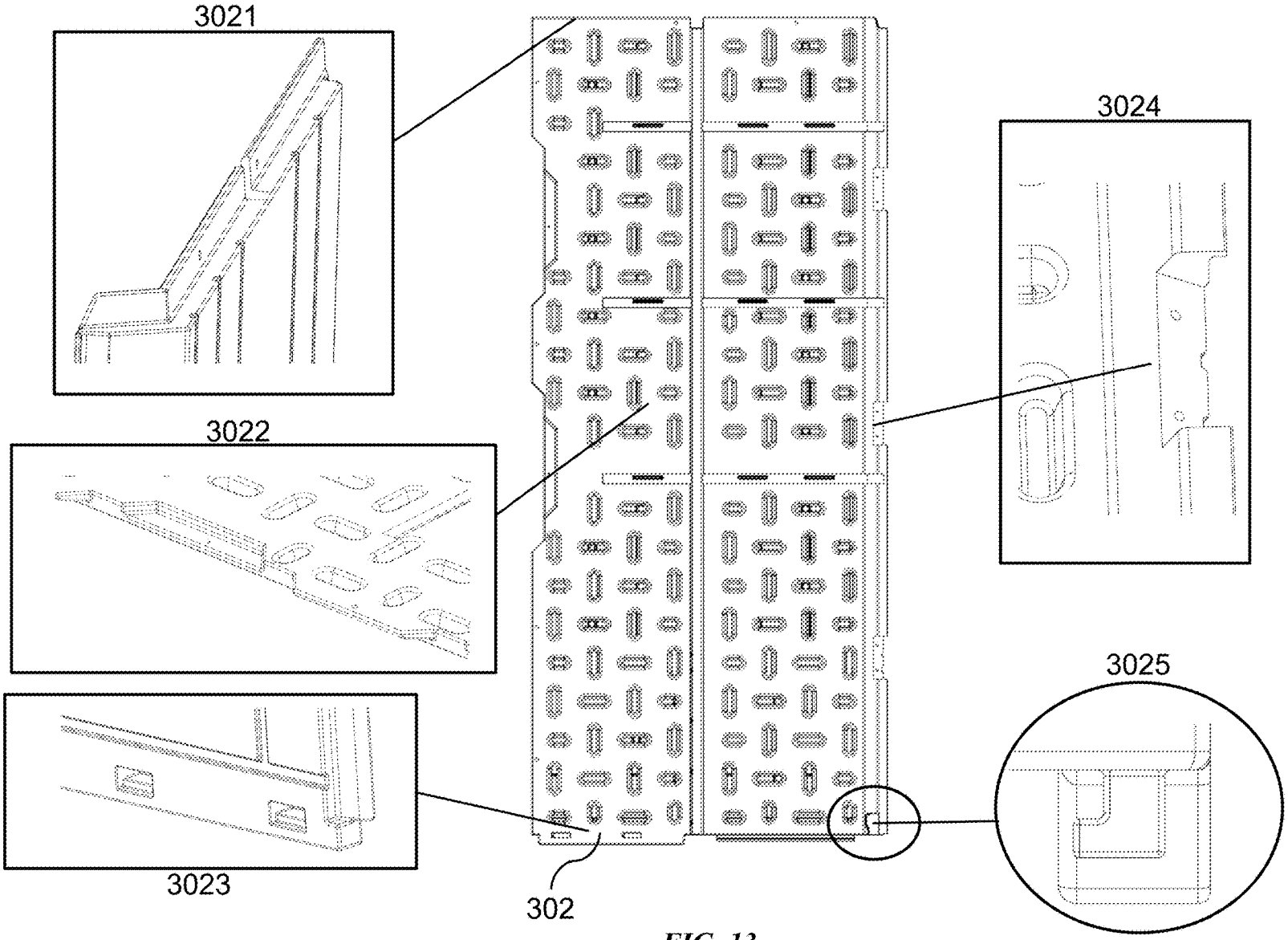
FIG. 13 shows multiple exploded views of foldable corner panel(s), according to an embodiment of the present subject matter.

FIG. 13 shows multiple exploded views of foldable corner panel(s), according to an embodiment of the present subject matter. According to some embodiments, a second foldable corner panel 302 can have a top side 3027 configured to be coupled to a lintel or a roof for the shed. A door hinge slot 3024 can be pre-manufactured so that a door can be connected to the panel. The bottom two sides along the two leafes of the panel 302 can be equied with one or more coupling mechanisms.

According to some embodiments, each leaf can have a different coupling structure from each other so that the installation is easier, and the structural stability is enhanced. For example, clip slots 3023 on first leaf can be coupled to clips arranged on a floor panel; an L-shaped slider 3025 on a second leaf can be coupled to a L-shaped rail on the floor panel.

In addition, the rear layer of second foldable corner panel 302 can comprise back strengthening ribs 3022. As shown in this drawing, evenly spaced and symmetrically arranged back strengthening ribs are arranged to provide enhanced stability of the plastic panel. According to some embodiments, back strengthening ribs 3022 can comprise vertical support grooves and horizontal support grooves. In particular, each vertical support groove can be surrounded by a plurality of horizontal support grooves. In addition, each horizontal support groove can be surrounded by a plurality of vertical support grooves.

Figure 14:
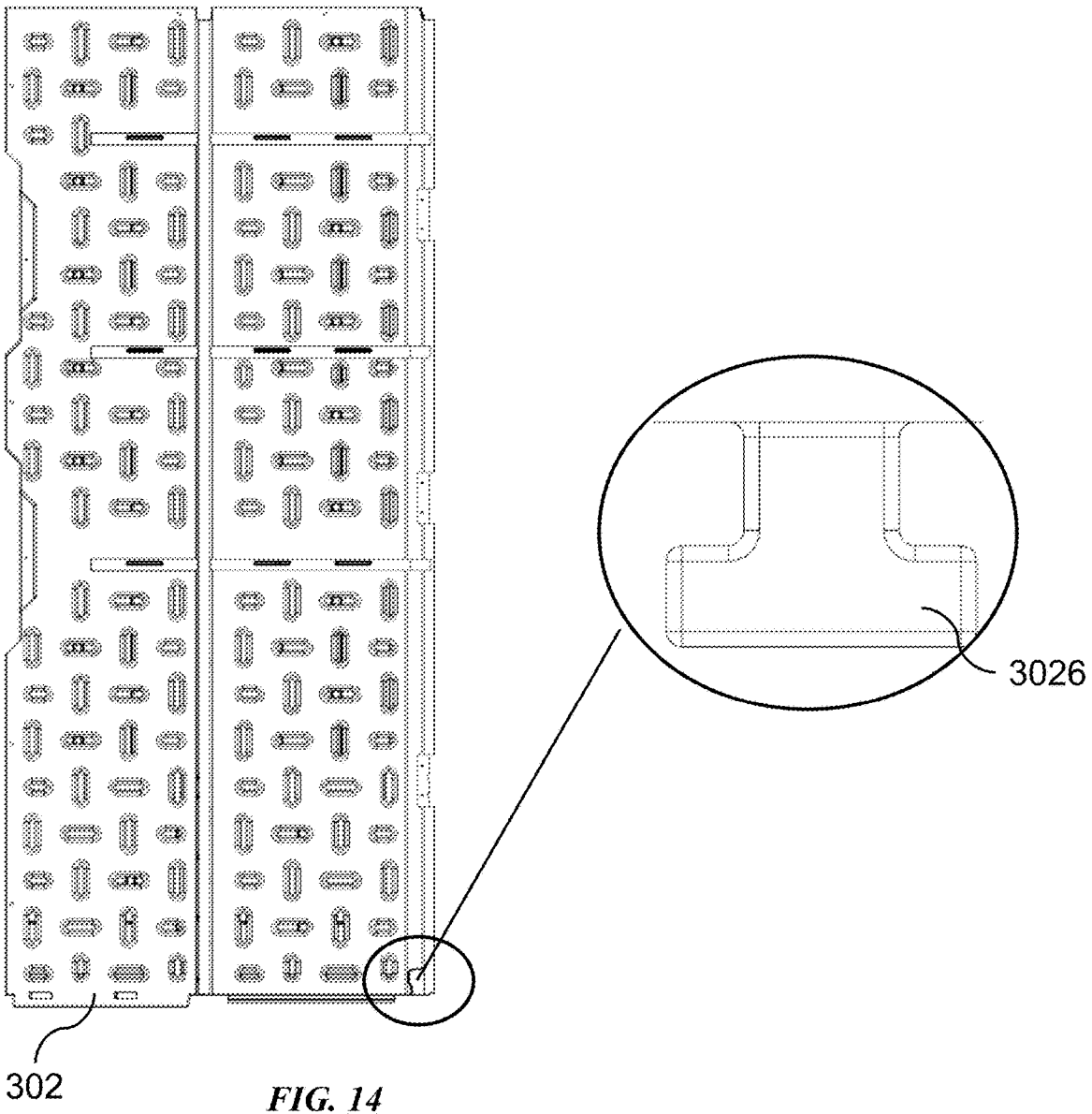
FIG. 14 shows an exploded view of foldable corner panel(s), according to an embodiment of the present subject matter.

FIG. 14 shows an exploded view of foldable corner panel(s), according to an embodiment of the present subject matter. According to some embodiments, second foldable corner panel 302 can have another type of slider, e.g., a T-shaped slider 3026, to engage with a T-shaped rail of a floor panel.

Figure 15:
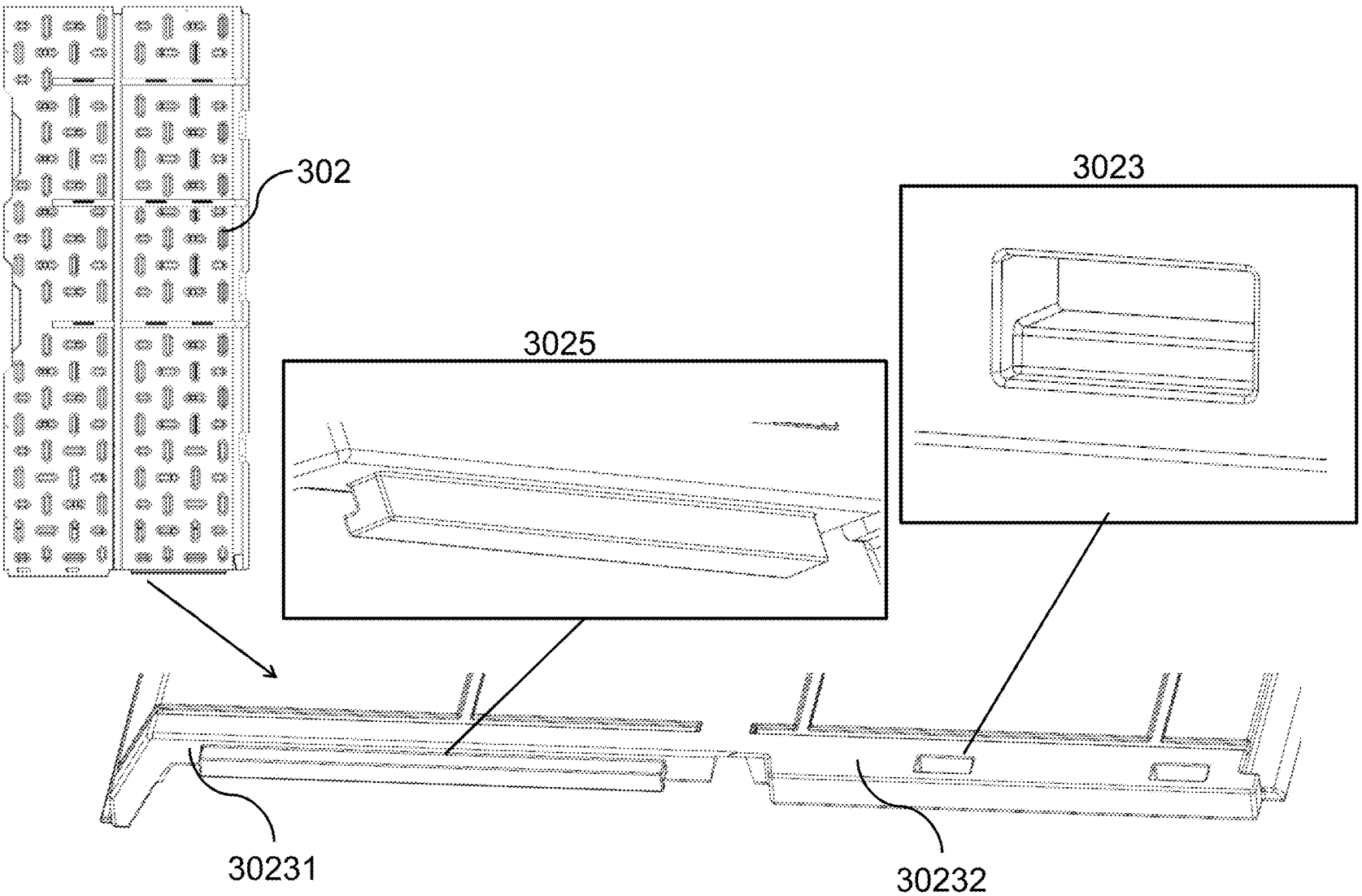
FIG. 15 shows two coupling mechanisms of foldable corner panel(s), according to an embodiment of the present subject matter.

FIG. 15 shows two coupling mechanisms of foldable corner panel(s), according to an embodiment of the present subject matter. According to some embodiments, second foldable corner panel 302 can be divided by an embedded folding groove into a first leaf 30231 and a second leaf 30232. As shown in the exploded views, first leaf 30231 can consist of an L-shaped slider 3025; second leaf 30232 can comprise clip slots 3023. According to some embodiments, the two leafs can incorporate two different coupling mechanisms. The two coupling mechanisms can adopt a contrasting engagement style, i.e. protruding v. receiving, to increase the binding force and stability between the panels. For example, a panel can have a protruding coupling portion, e.g., L-shaped slider 3025, arranged on one leaf, and a receiving coupling portion, e.g., clip slots 3023, arranged on another leaf.

Figure 16:
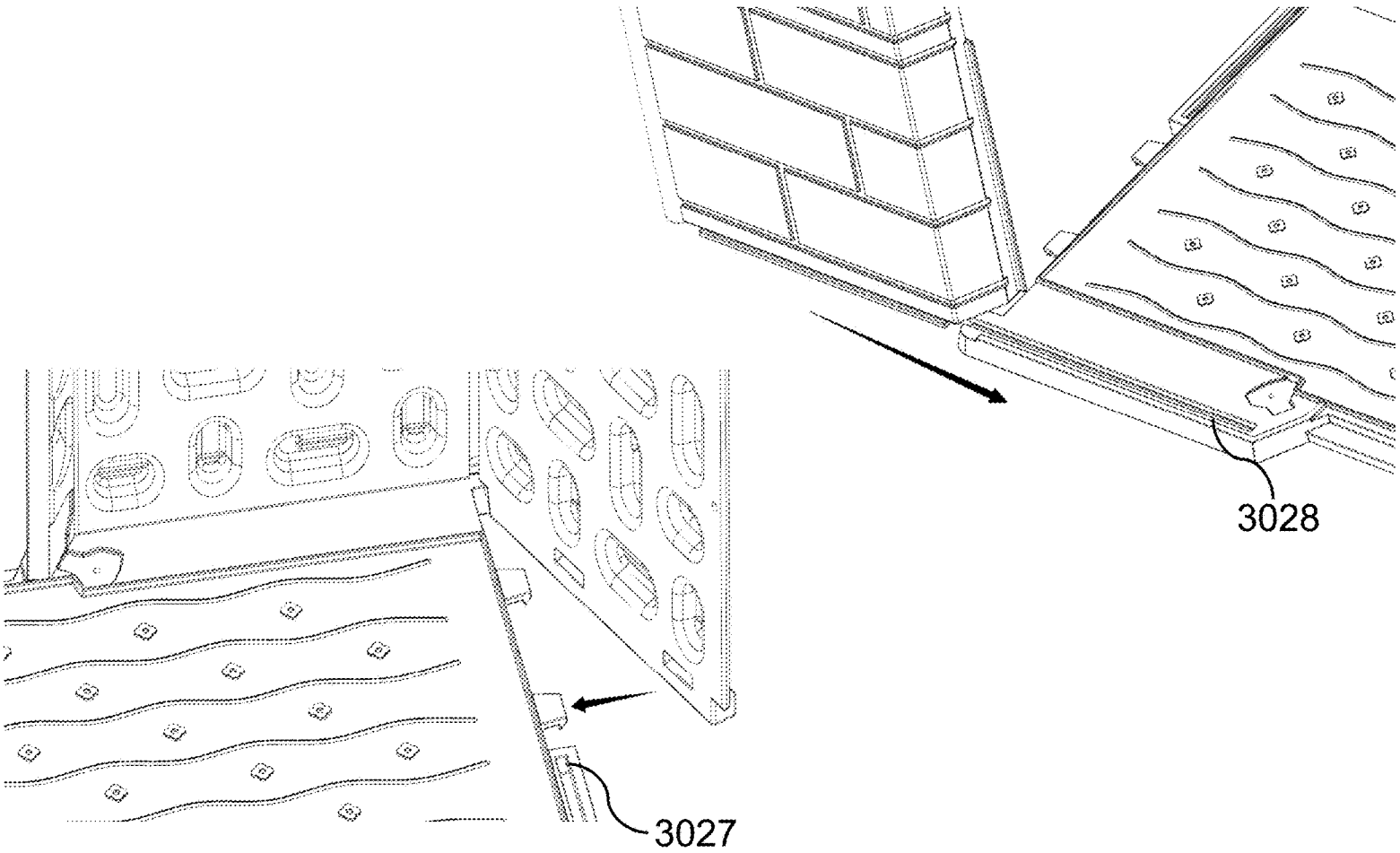
FIG. 16 shows two coupling mechanisms of foldable corner panel(s), according to an embodiment of the present subject matter.

FIG. 16 shows two coupling mechanisms of foldable corner panel(s), according to an embodiment of the present subject matter. As shown in this drawing, a clip coupling structure 3027 is arranged on a first side of the turnable corner panel, whereas a slider coupling structure 3028 is arranged on a second side of the corner panel.

Figure 17:
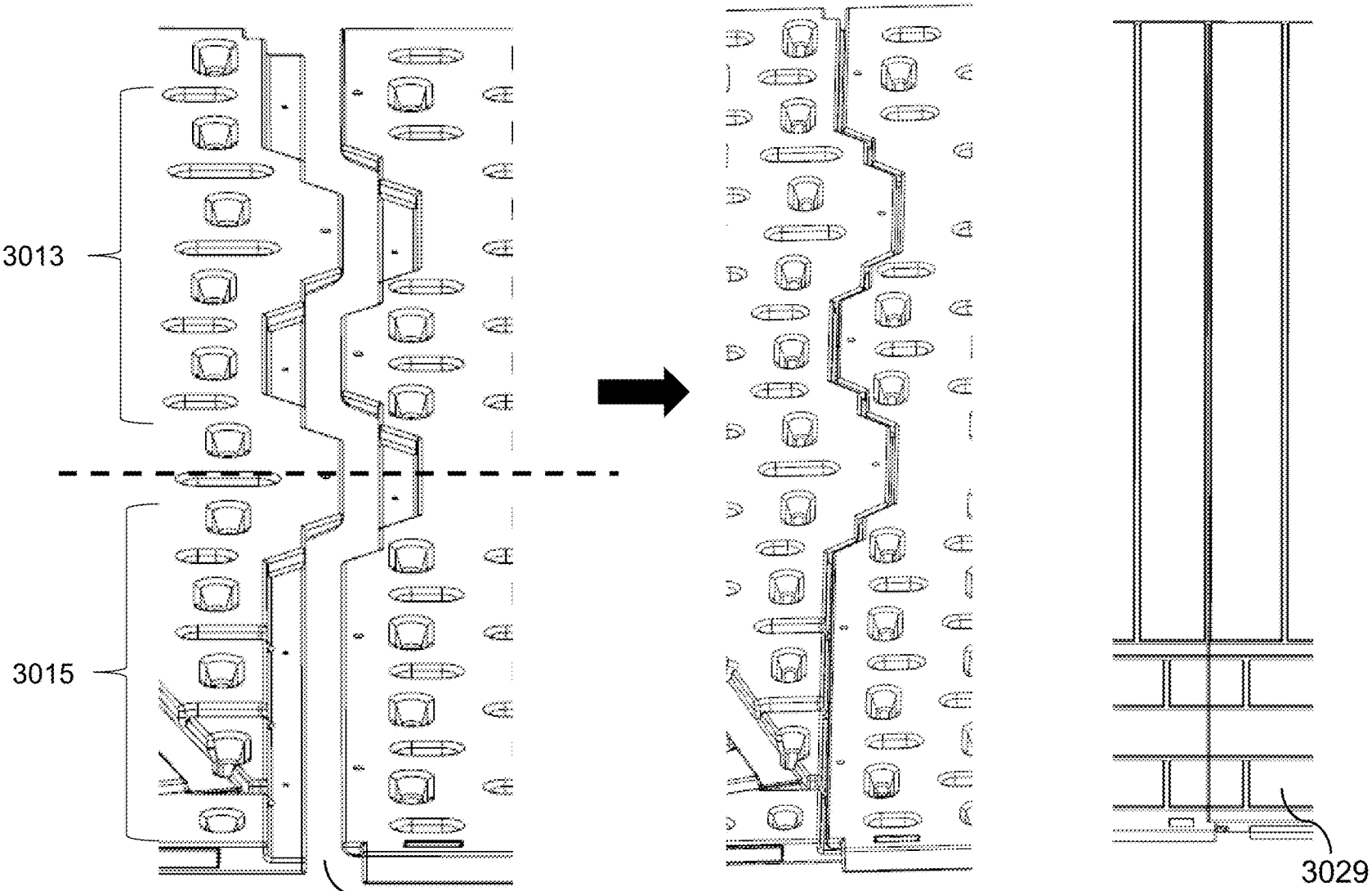
FIG. 17 shows interlocking teeth couplings between two connected wall panels, according to an embodiment of the present subject matter.

FIG. 17 shows interlocking teeth couplings between two connected wall panels, according to an embodiment of the present subject matter. According to some embodiments, interlocked teeth couplings 3011 can comprise a plurality of protrusions/lips on the left wall panel and corresponding recesses arranged on the right wall panel. It is further noted that each protrusion and recess can have varied depths of plastic material, forming varied ledges based on the design and contour of the teeth couplings. Such varied, multi-level engagement can increase the contact surface between the two panels. According to some embodiments, the protrusions/lips and the recesses are distributed asymmetrically along with connecting line. For example, the interlocked teeth portions can be placed closer to or within the upper half region 3013, instead of the lower half region 3015. This way, the installation can take less careful alignment as the lower half region shall be coupled with the floor panels.

One advantage of interlocked teeth couplings 3011 is to increase the binding and unity of any two coupled panels. The increased contact surface resulting from the teeth couplings, protrusions and recesses at varied depths, can share any force applied to the panels, thus improving the stability of the structure. Such couplings can be used between the wall panels, the floor panels, or any other plastic panels. Furthermore, one or more additional fastening tools, such as screws, can be adopted to further secure the connected panels.

FIG. 17 further shows an exterior view 3029 of interlocked teeth couplings 3011. After the assembly, there is a straight seam line formed by the interlocked teeth couplings 3011. Thus, the interlocked teeth couplings can increase the structure stability without sacrificing the aesthetic appeal of the product.

Figure 18:
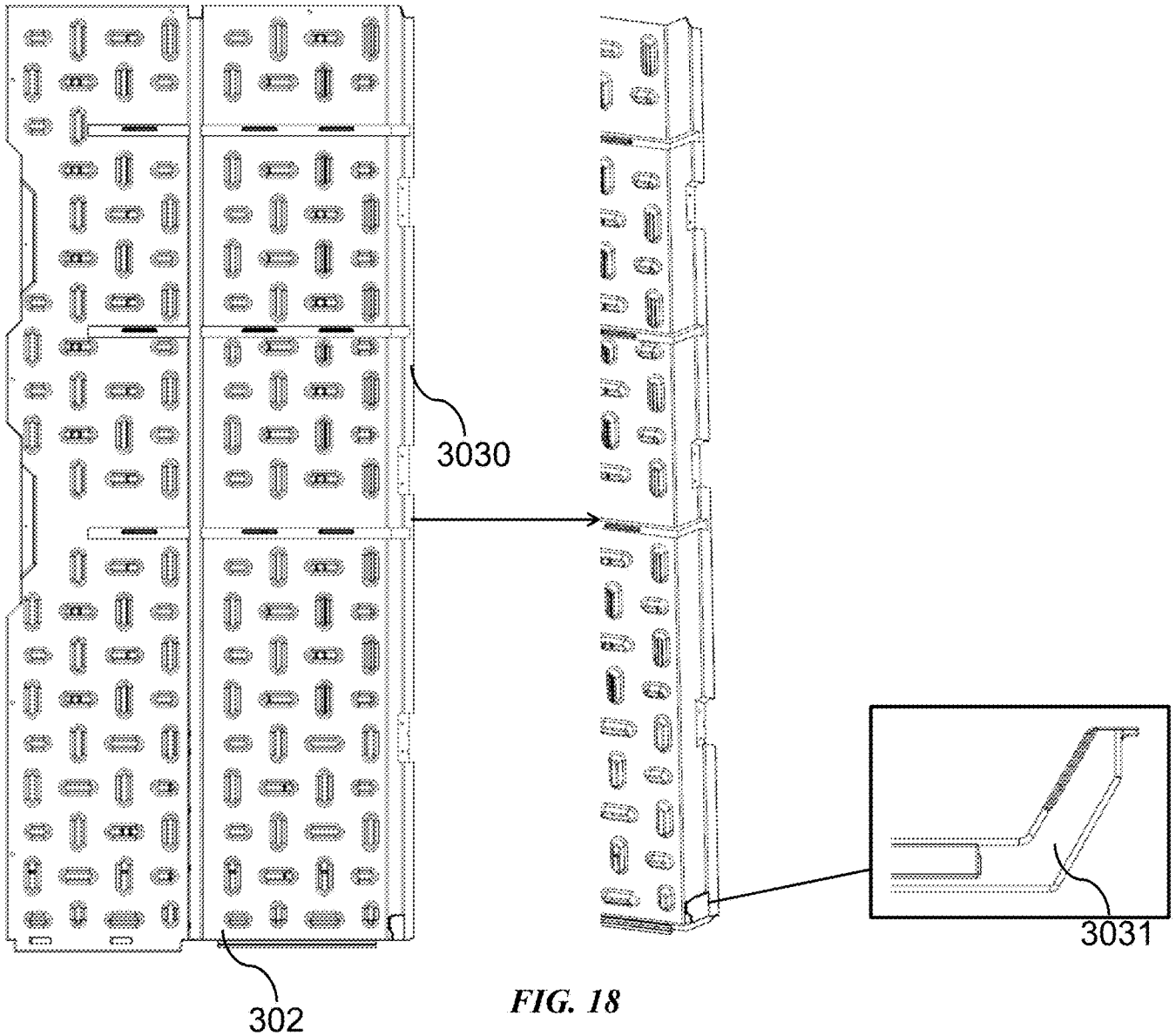
FIG. 18 shows a foldable corner panel with a concave door frame, according to an embodiment of the present subject matter. Traditionally, a shed's door is flush with the wall surface.

FIG. 18 shows a foldable corner panel with a concave door frame, according to an embodiment of the present subject matter. Traditionally, a shed's door is flush with the wall surface. According to some embodiments, the edge of second foldable corner panel 302 can transition into a concave door frame 3030, generating an inwardly concave surface 3031. This concave surface 3031 can be sloped towards a door. As illustrated in the drawing, the concave surface 3031 can be broader than a standard door frame, thus enhancing the stability of the door-wall structure. Moreover, the concave surface 3031 can also serve as a door stopper or brake when the shed door is opened, preventing the door from harshly hitting the wall panels. The design of the concave door frame also can permit the door to recess below the surface of the wall, offering protection to the door from weather elements such as rain, sunlight, or wind.

Figure 19:
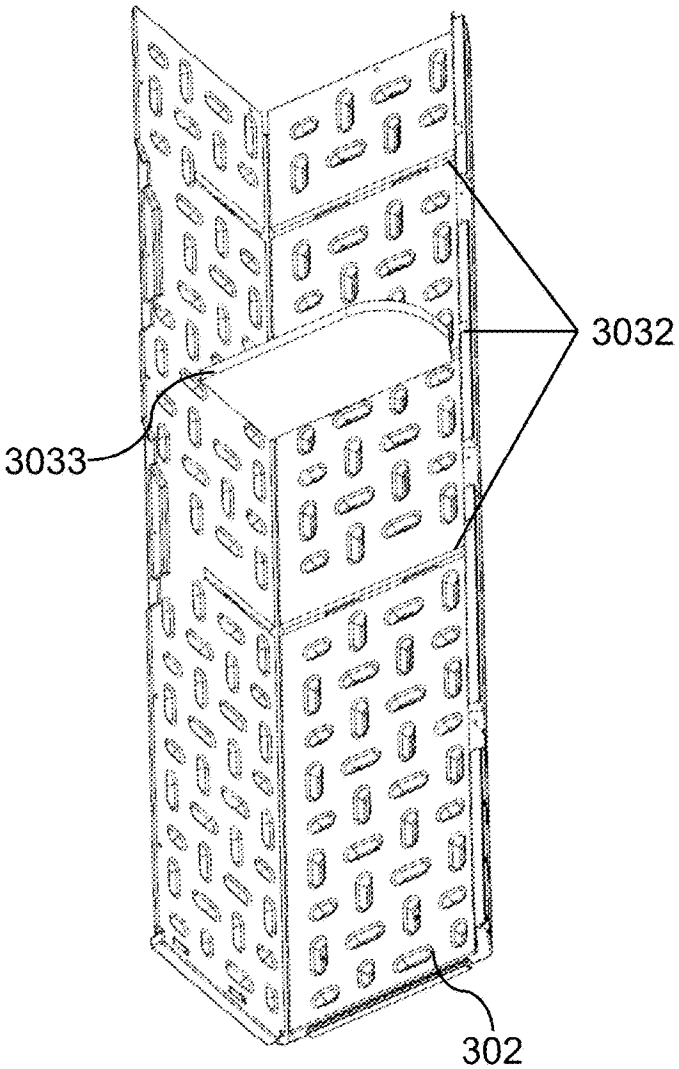
FIG. 19 shows a foldable corner panel with shelf groove (s), according to an embodiment of the present subject matter.

FIG. 19 shows a foldable corner panel with shelf groove(s), according to an embodiment of the present subject matter. According to some embodiments, a foldable corner panel, e.g., second foldable corner panel 302 can consist of a number of shelf grooves 3032 that are manufactured and embedded into the interior surface of the two-panel leaves. A number of molded plastic selfs 3033 can be slotted into shelf grooves 3032. Such shelves can offer not only additional storage space within the shed but also increase the structural stability of the corner panel assembly.

Figure 20:
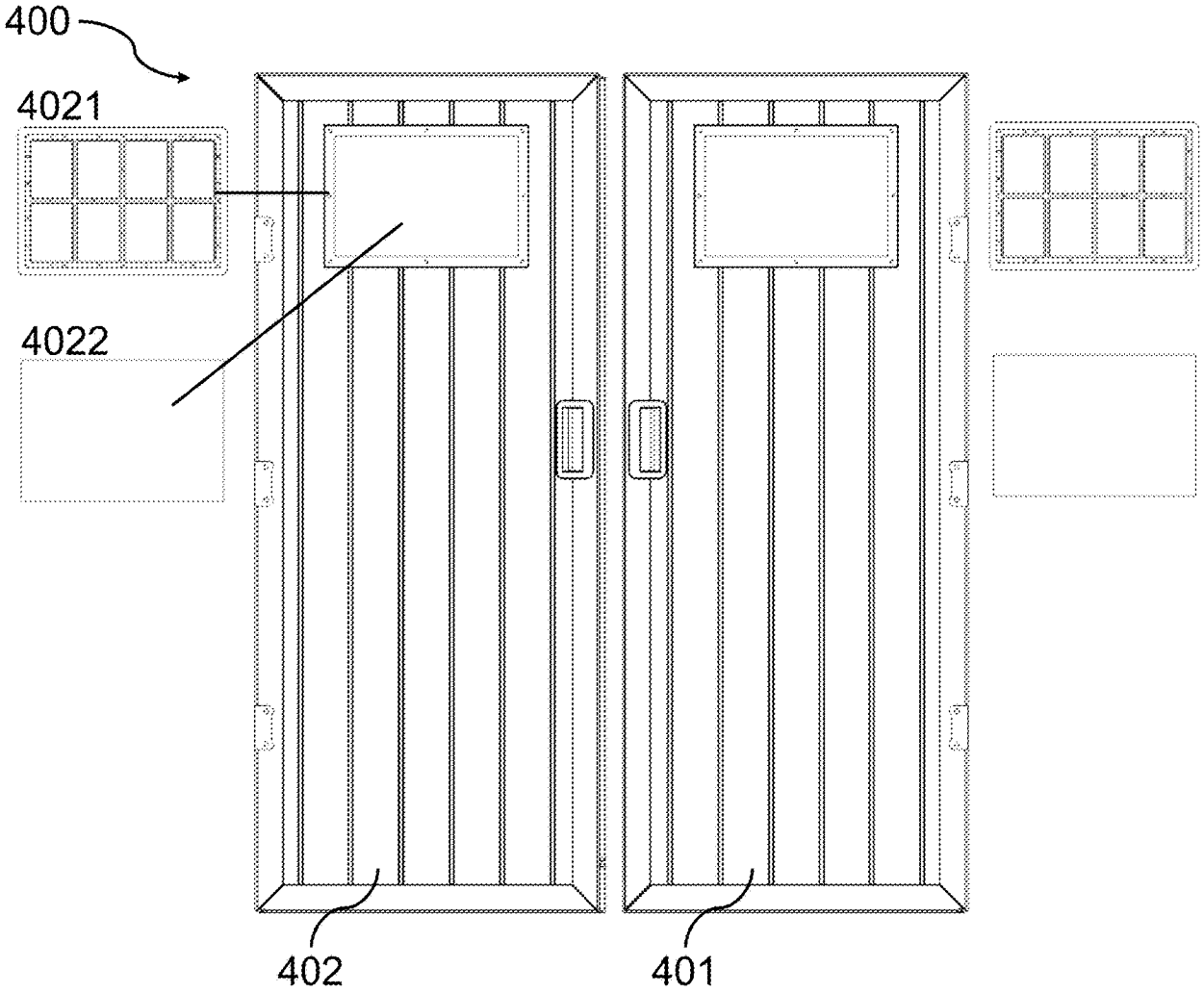
FIG. 20 shows a door installed in a storage shed structure, according to an embodiment of the present subject matter.

FIG. 20 shows a door installed in a storage shed structure, according to an embodiment of the present subject matter. According to some embodiments, a door 400 can be coupled to the storage shed connectors. Door 400 can comprise a first door panel 401 and a second door panel 402. Each door panel can further consist of a window 4021 and a window panel 4022 that is transparent. Door 400 can be a molded or an injected plastic door.

Figure 21:
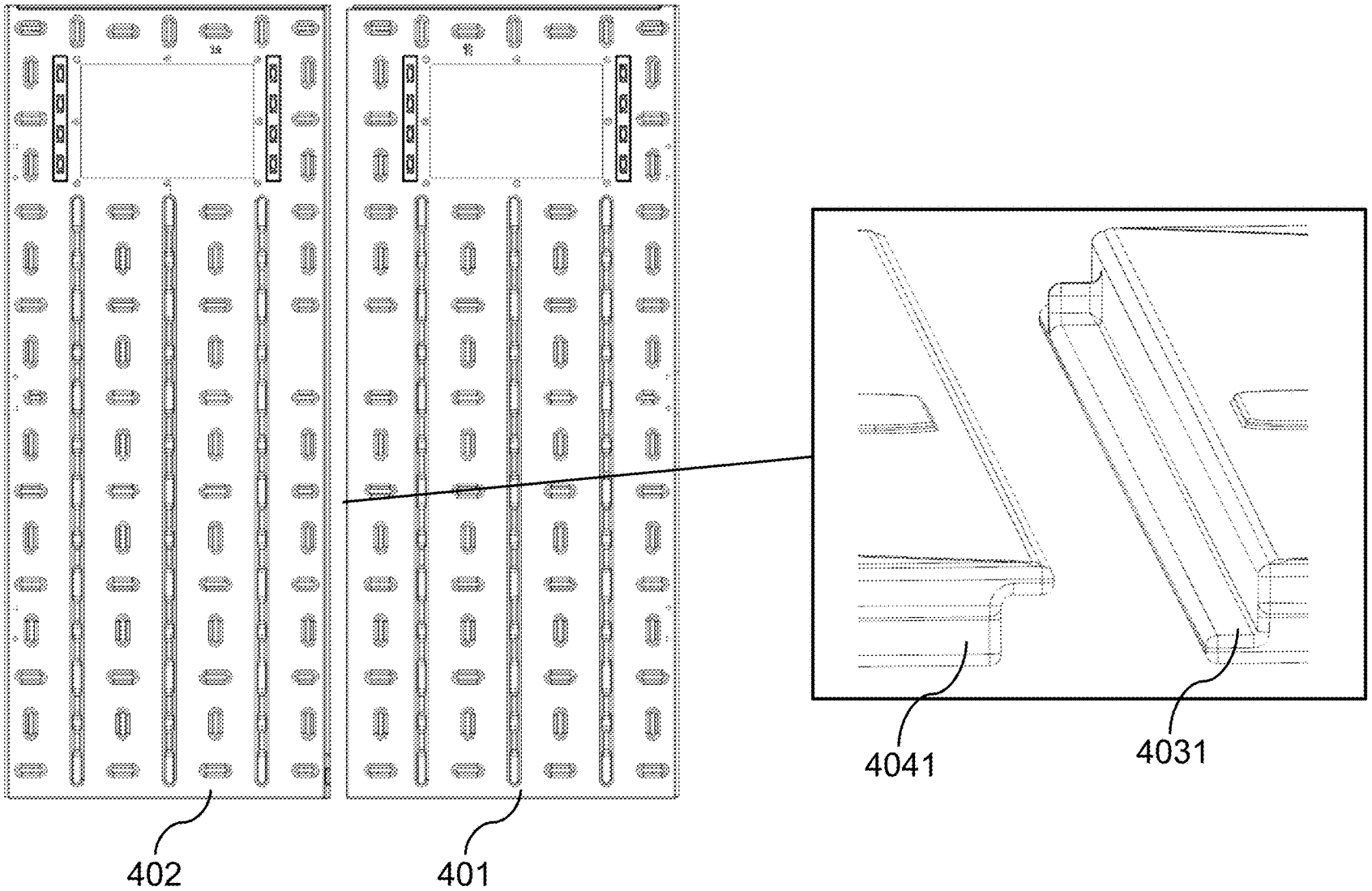
FIG. 21 shows a rear view of the door in FIG. 19, according to an embodiment of the present subject matter.

FIG. 21 shows a rear view of the door in FIG. 20, according to an embodiment of the present subject matter. To increase contact surface between the two doors, the edges of the door panels can have matching lips. For example, a first L-shaped ledge 4041 arranged on second door panel 402 can engage with a second L-shaped ledge 4031 arranged on first door panel 401. Such L-shaped ledges can provide optimized sealing of the door, effectively preventing water/rain enter the shed.

Figure 22:
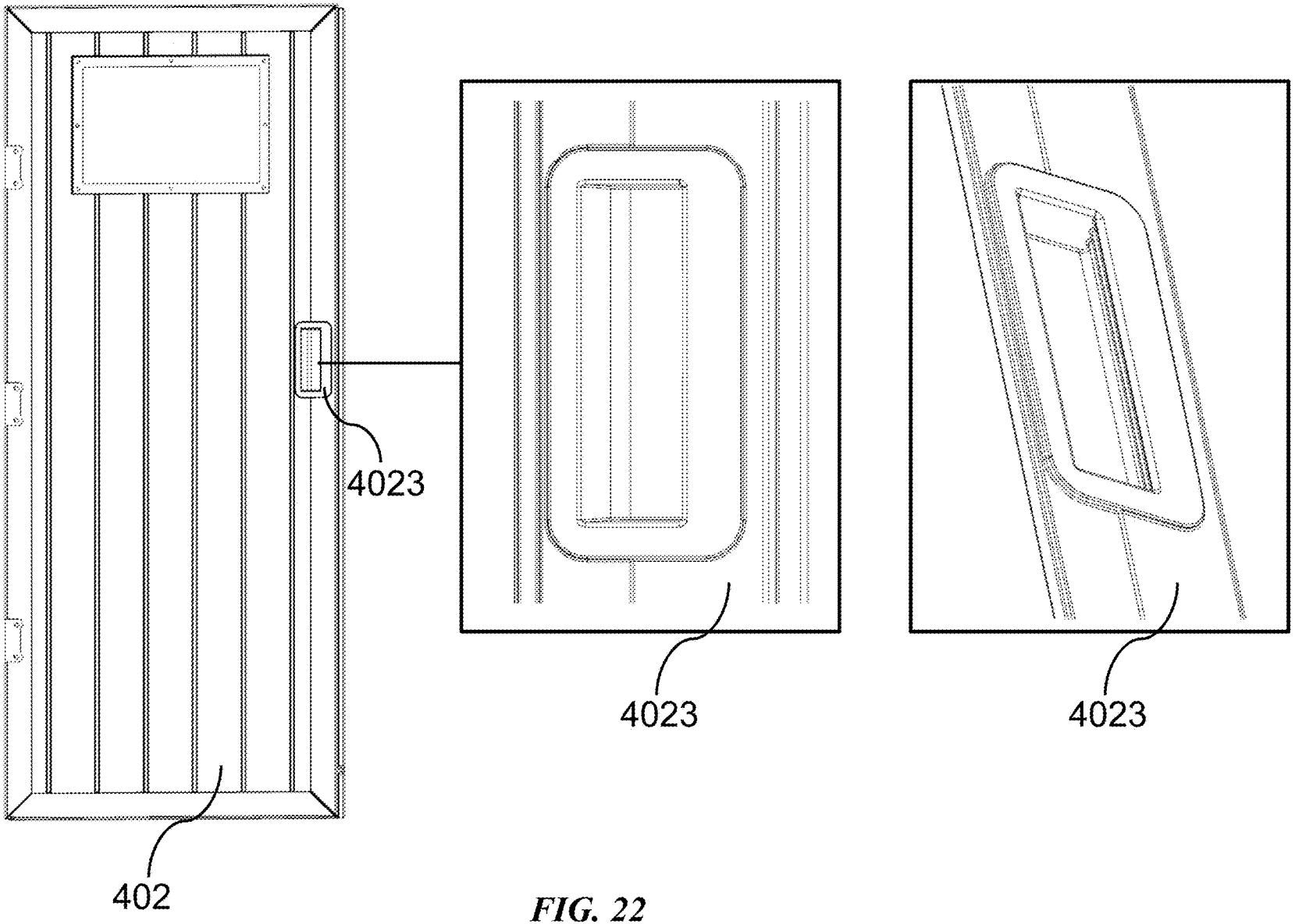
FIG. 22 shows a door handle for a door, according to an embodiment of the present subject matter.

FIG. 22 shows a door handle for a door, according to an embodiment of the present subject matter. Traditionally, a user is required to manually install an additional door handle to a shed. In the present subject matter, a shed door, such as the second door 402, can come pre-equipped with an integrated concave handle 4023, eliminating the need for further installation. Additionally, this design of the concave door handle can ensure the absence of any outward projections from the door.

Figure 23:
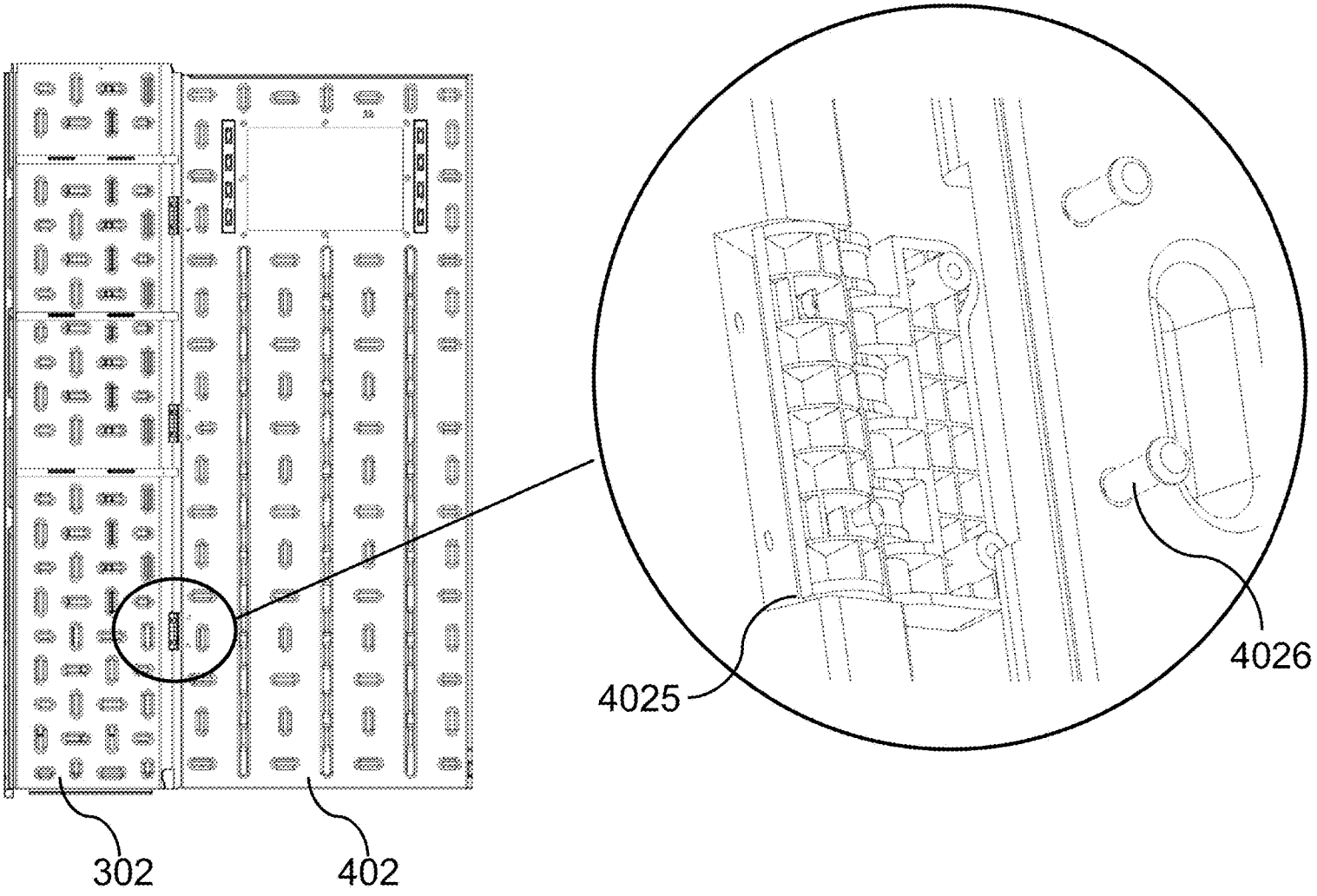
FIG. 23 shows a rear view of a door coupled with a wall panel, according to an embodiment of the present subject matter.

FIG. 23 shows a rear view of a door coupled with a wall panel, according to an embodiment of the present subject matter. According to some embodiments, the second door 402 can be attached to second foldable corner panel 302 via one or more rotatable connection tools, such as a hinge 4025 and screws 4026. Another pivotable mechanism can be adopted by the door-wall connection.

Figure 24:
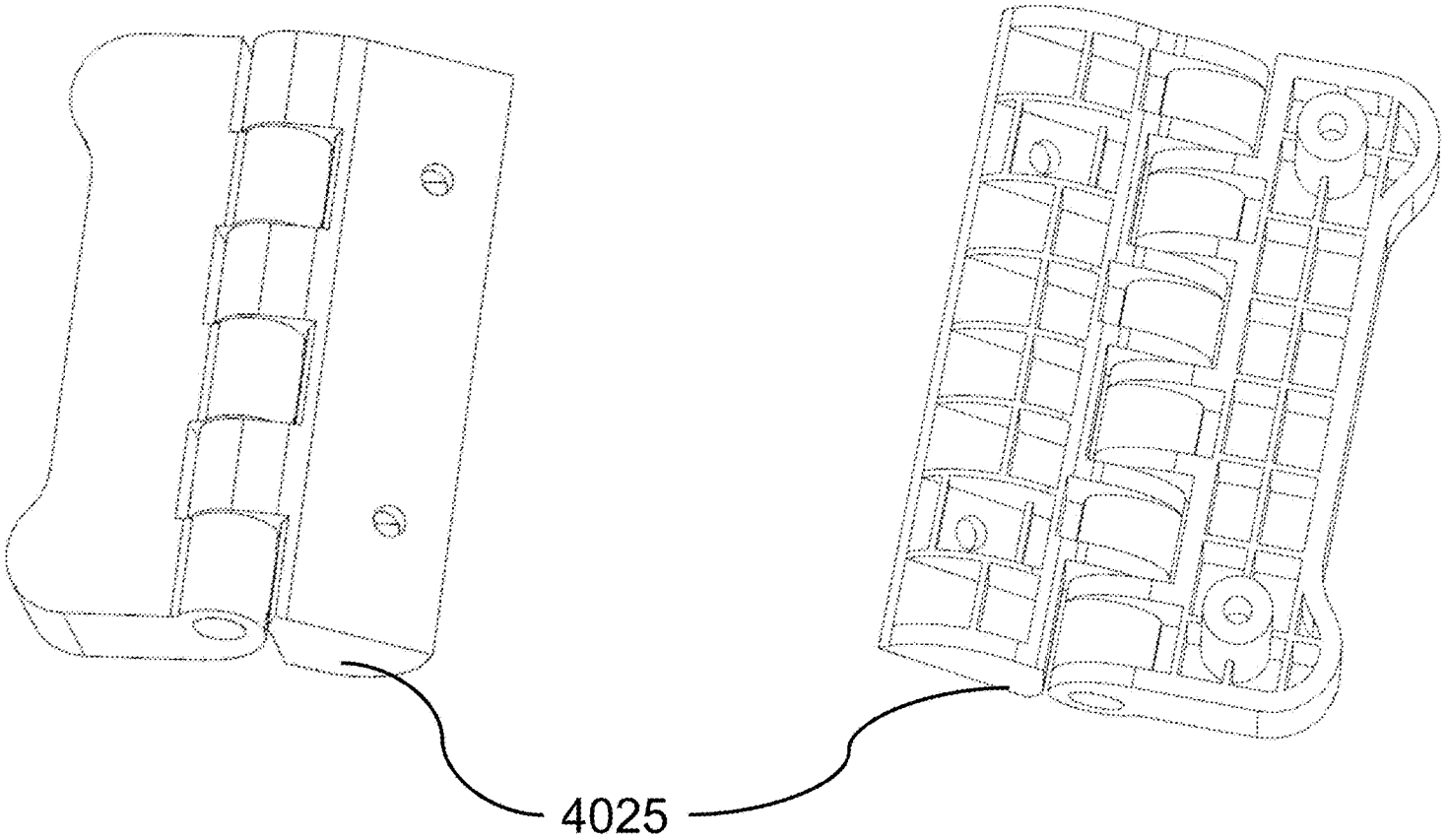
FIG. 24 shows a hinge for the door, according to an embodiment of the present subject matter.

FIG. 24 shows a hinge for the door, according to an embodiment of the present subject matter. According to some embodiments, hinge 4025 can be made of injected plastic. It can also be made of other materials such as metal.

Figure 25:
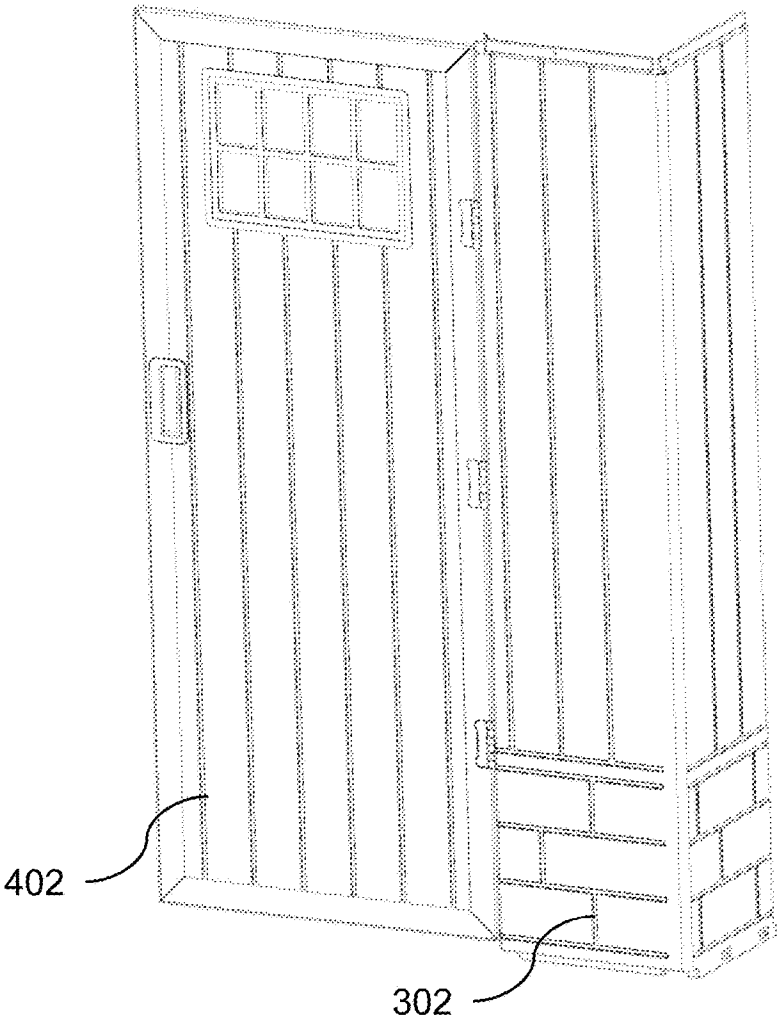
FIG. 25 shows a foldable corner panel coupled with a door, according to an embodiment of the present subject matter.
Figure 25:
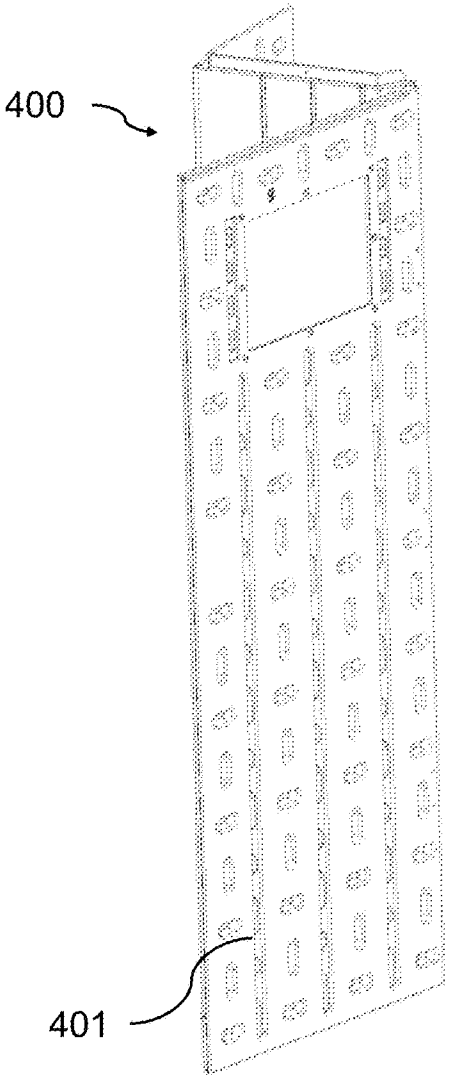

FIG. 25 shows a foldable corner panel coupled with a door, according to an embodiment of the present subject matter. According to some embodiments, the shed storage structure can comprise a door 400 that further consists of a first door panel 401 and a second door panel 402. Such door 400 can be connected to a foldable corner panel, such as second foldable corner panel 302. According to some embodiments, the shed storage structure can comprise a front door and a back door. According to some embodiments, the shed storage structure can have only a front door.

Figure 26:
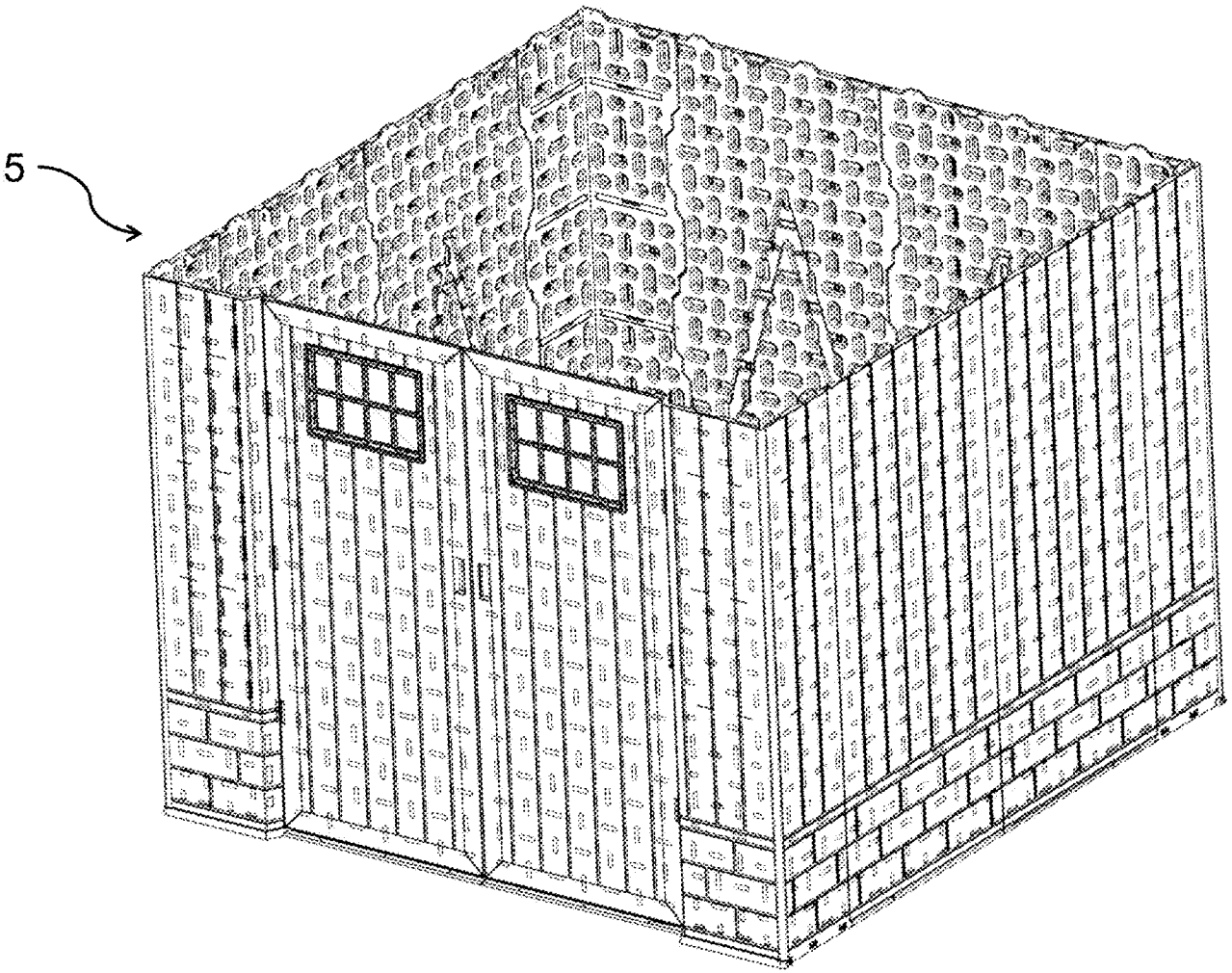
FIG. 26 shows a partially completed storage shed, according to an embodiment of the present subject matter.

FIG. 26 shows a partially completed storage shed, according to an embodiment of the present subject matter. According to some embodiments, a partially completed storage shed 5 can comprise a floor, a surrounding wall consisting of flat panel and foldable corner panels, one or more doors affixed to the shed. The size of the shed can be adjusted by installing more floor panels and flat panels.

Figure 27:
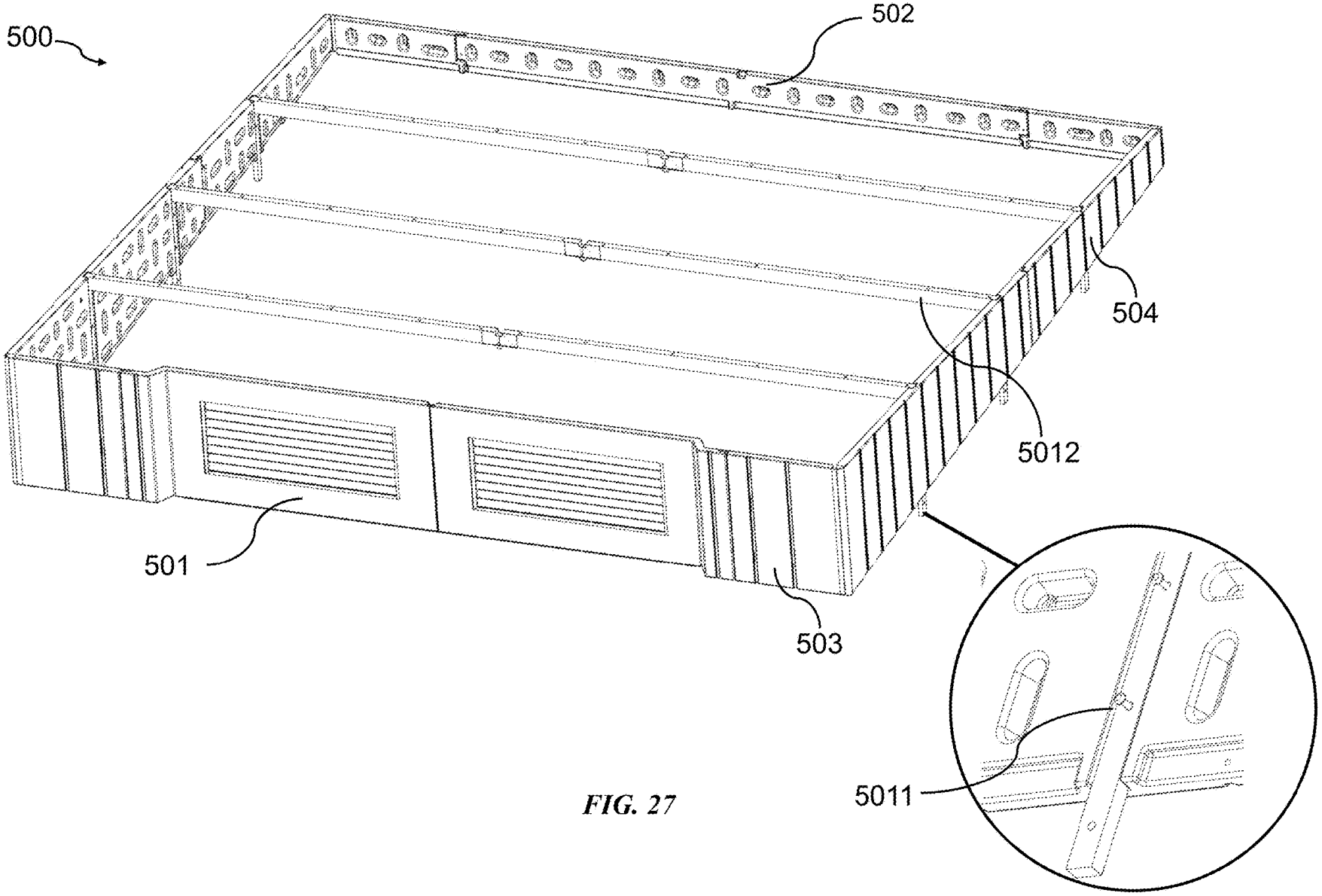
FIG. 27 shows an assembled lintel for the outdoor storage shed, according to an embodiment of the present subject matter.

FIG. 27 shows an assembled lintel for the outdoor storage shed, according to an embodiment of the present subject matter. According to some embodiments, a lintel 500 can function as a supporting component between the shed's wall panels and the roof. Lintel 500 can comprise front lintel 501, rear lintel 502, front foldable lintel panel 503 and rear foldable lintel panel 504. Lintel 500 can be fixed to wall panels and roof via connectors such as screws 5011. Supporting beams 5012 can be inserted across the lintel 500 to provide extra support to the roof, which can withstand heavy weight such as accumulated snow or extreme weather.

Figure 28:
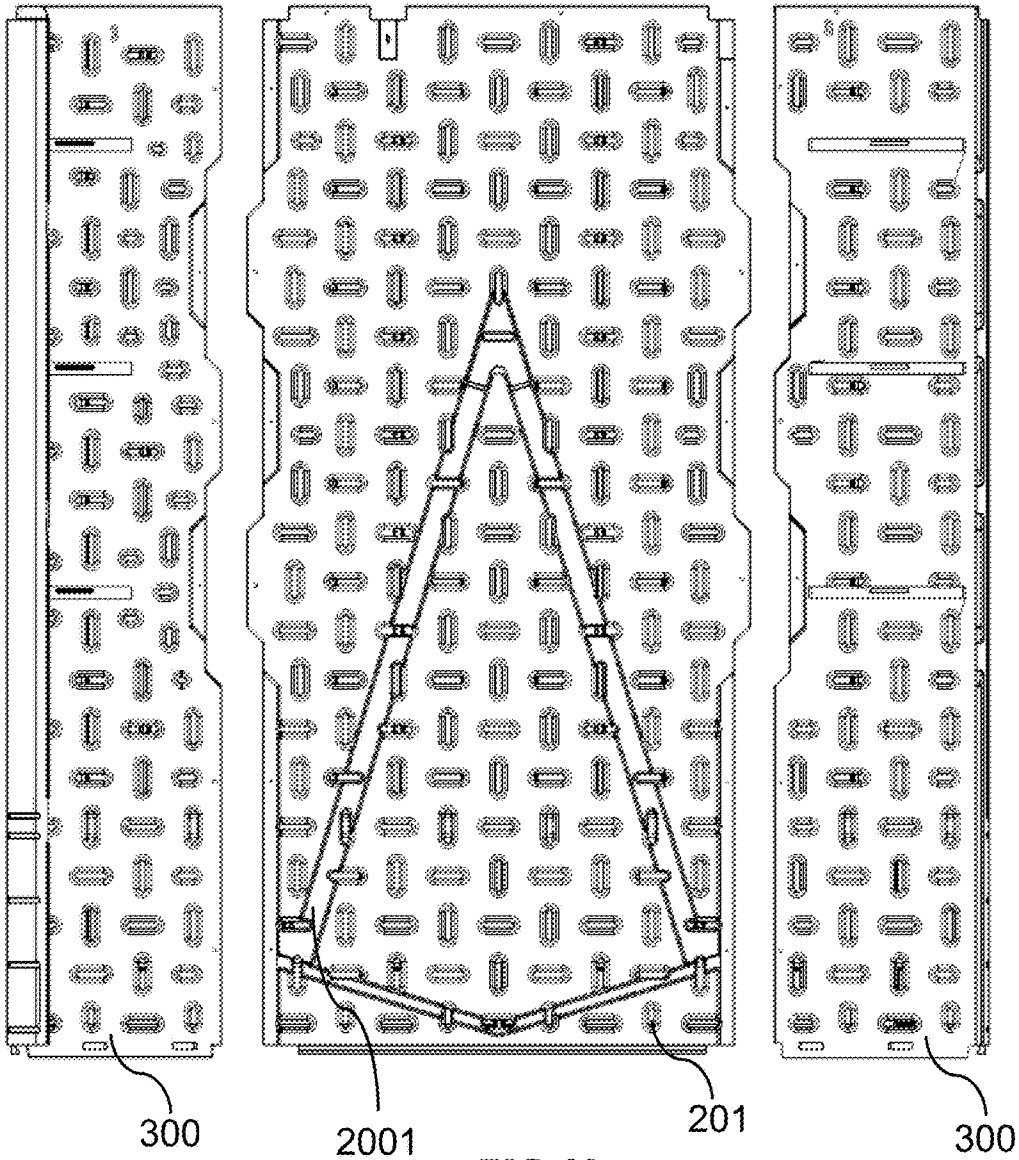
FIG. 28 shows a rear view of flat wall panel(s) for storing the supporting beams, according to an embodiment of the present subject matter.

FIG. 28 shows a rear view of flat wall panel(s) for storing the supporting beams, according to an embodiment of the present subject matter. A base flat panel 201 can have pre-manufactured integrated beam slots 2001 to store metal supporting beams 5012 during transportation. These metal support beams 5012, once assembled and installed, can provide support for a designated section of the outdoor storage shed, such as the roof. As shown in this drawing, the base flat panel can be coupled to two foldable corner panels 300 via at least the interlocked teeth couplings.

Figure 29:
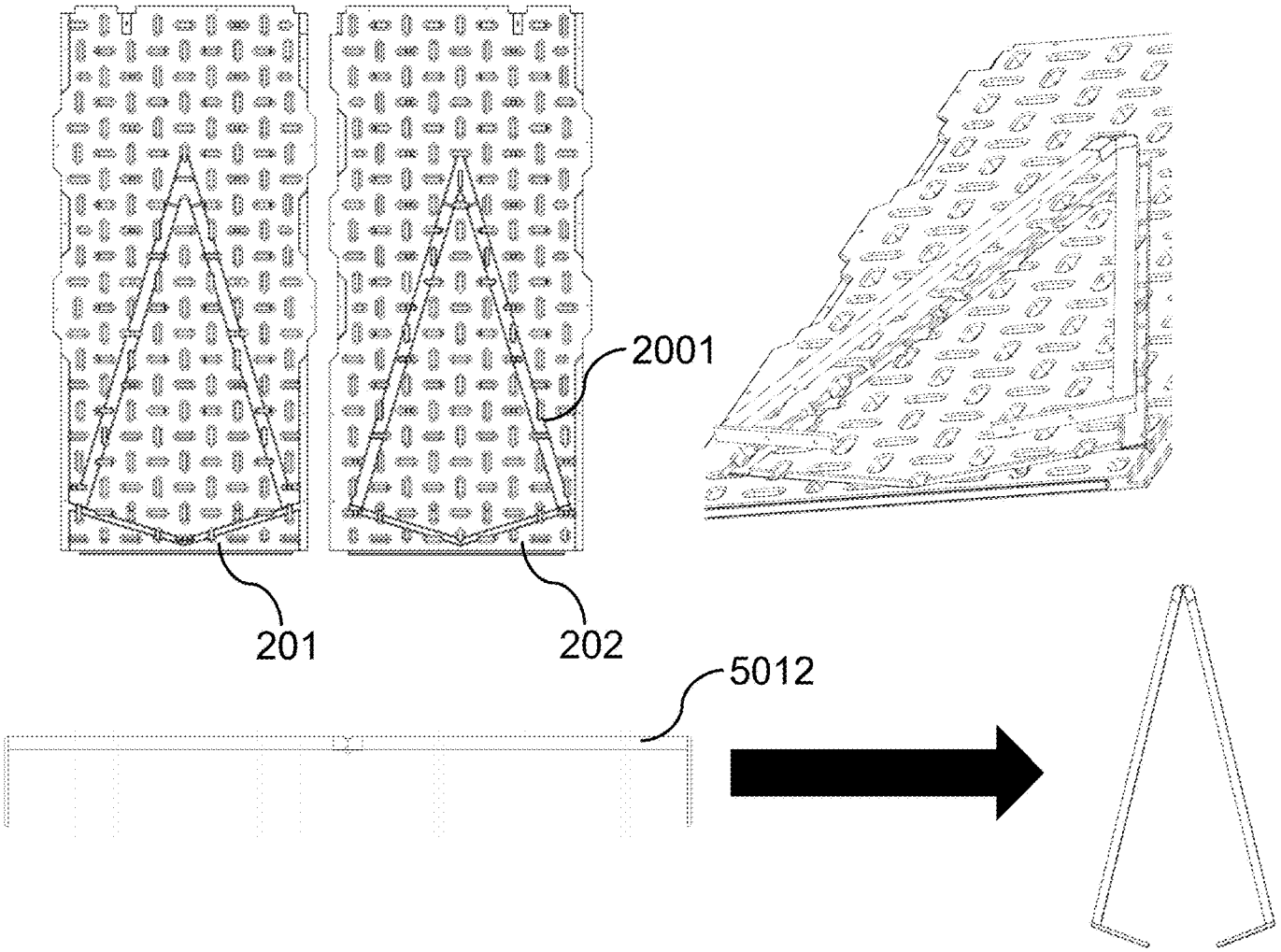
FIG. 29 shows a rear view of flat wall panels(s) with stored supporting beams, according to an embodiment of the present subject matter.

FIG. 29 shows a rear view of flat wall panels(s) with stored supporting beams, according to an embodiment of the present subject matter. Multiple supporting beams 5012 can be stored within the rear layer of a plastic molded panel, e.g., 201 and 202. As shown in this example, supporting beams can be split into two portions and connected via fastening tools during installation. To enable convenient retrieval by the user, the pre-manufactured beam slots 2001 that are embedded within the plastic layer can have a depth shallower or smaller than the depth of the supporting beams, e.g., half the depth. During transportation, a second panel, securely laying on top of the beam slots, can function as a fastener for the stored beams to prevent them from scratching and damaging other molded plastic panels in the package.

Figure 30:
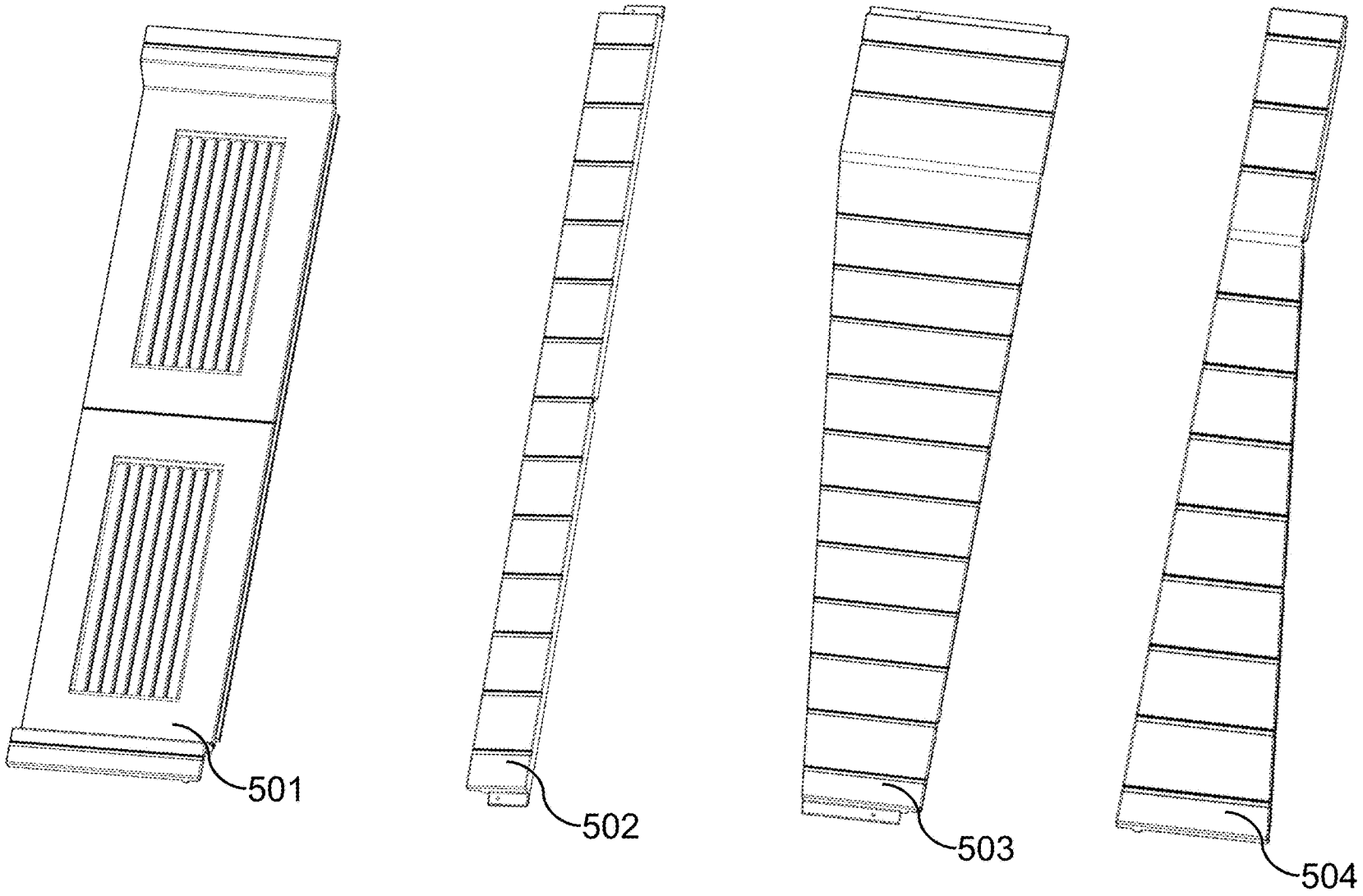
FIG. 30 shows component panels of a lintel, according to an embodiment of the present subject matter.

FIG. 30 shows component panels of a lintel, according to an embodiment of the present subject matter. According to some embodiments, the packaged components for the lintel can consist the following main parts: a front lintel 501, two front foldable lintel panels 503, two rear foldable lintel panels 504, and a rear lintel 502.

Figure 31:
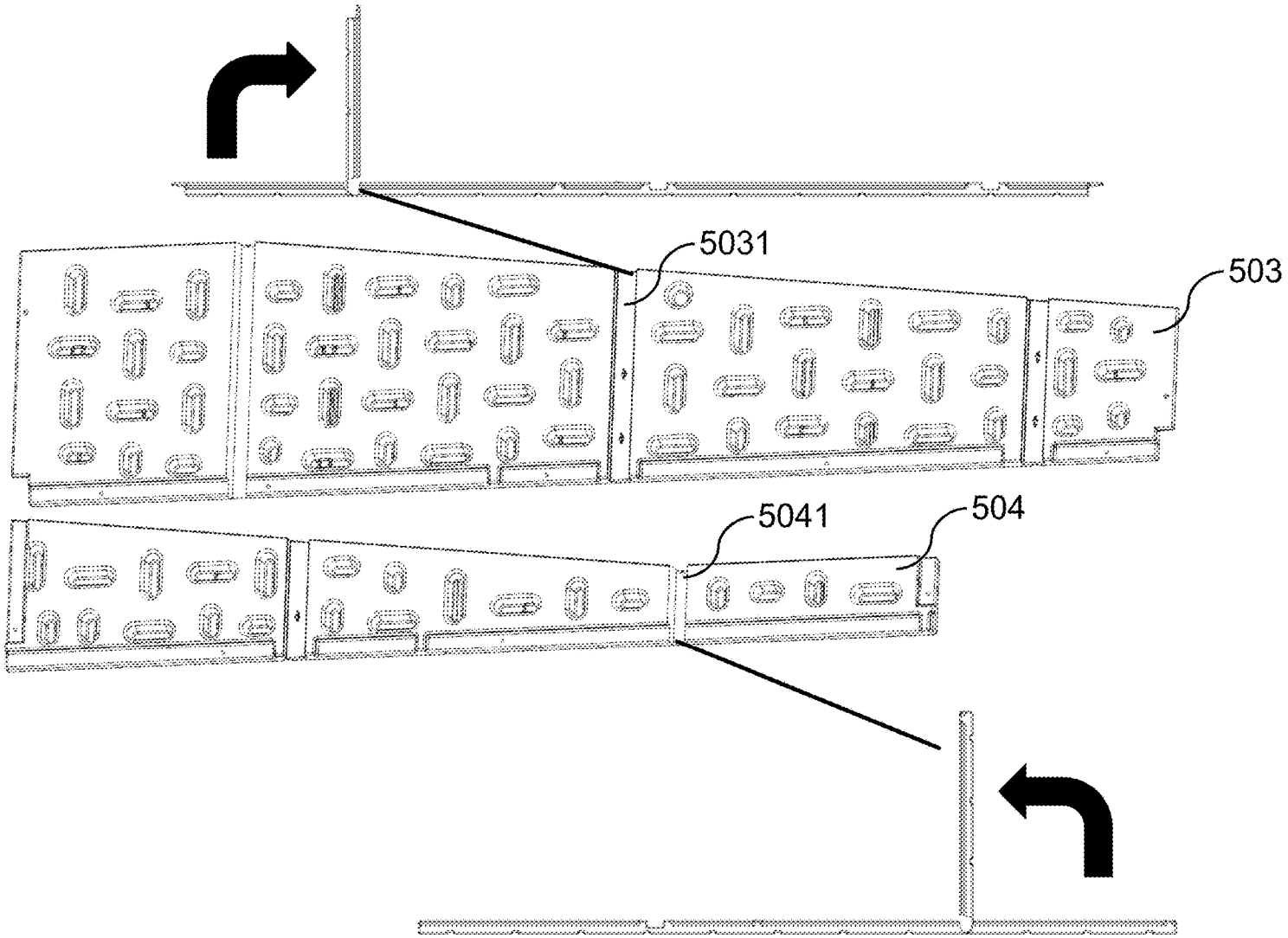
FIG. 31 shows rear views of component panels of a lintel, according to an embodiment of the present subject matter.

FIG. 31 shows rear views of component panels of a lintel, according to an embodiment of the present subject matter. According to some embodiments, the combined size and shape of a front foldable lintel panel 503 and a rear foldable lintel panel 504 can be substantially the same size and space of a full wall/floor panel. A first folding groove 5031, embedded in front foldable lintel panel 503 can be manufactured by injecting less or thinner plastic than the rest of the roof panel. During transportation, front foldable lintel panel 503 can be folded into smaller size at first folding groove 5031, which is similar sized with the other panels. During installation, front foldable lintel panel 503 can unfold and form a flat surface. Similarly, rear foldable lintel panel 504 can include an integrated second folding groove 5041, which can enable the folding and unfolding of the panel.

Figure 32:
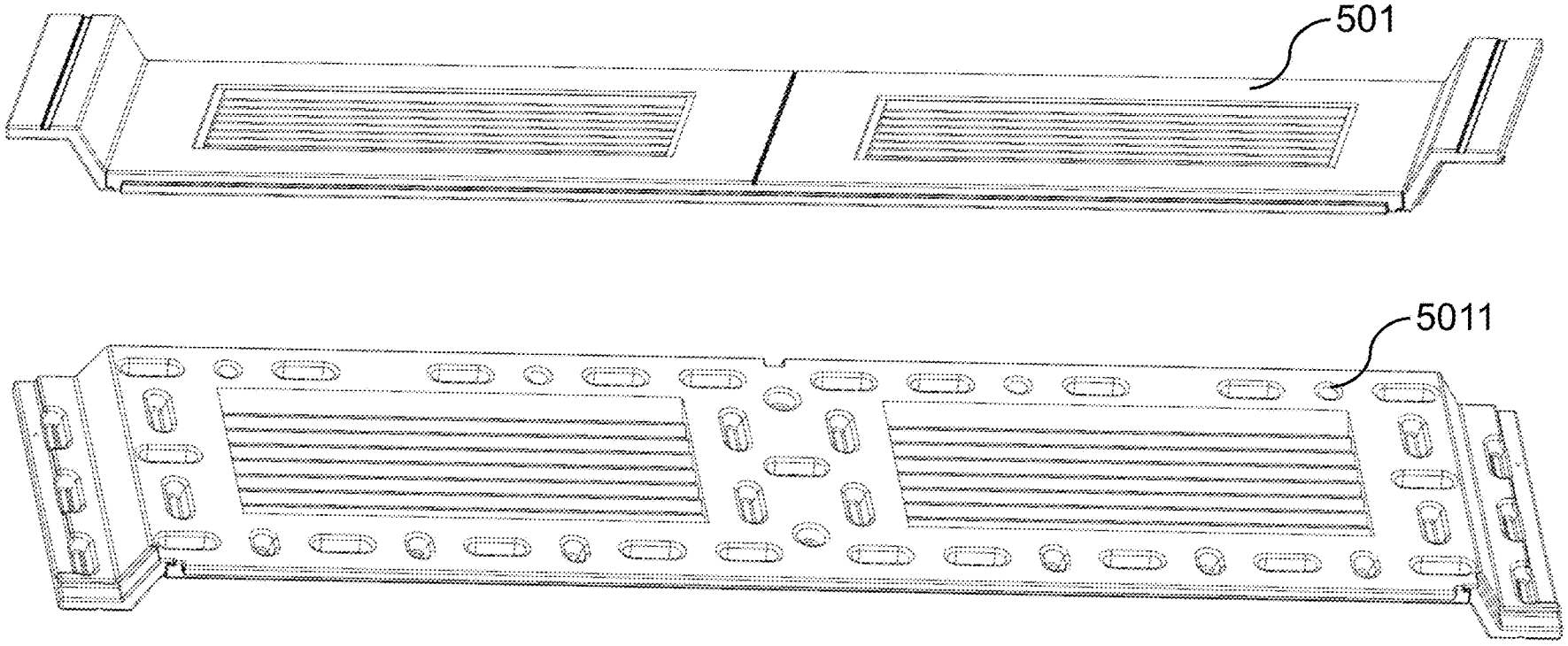
FIG. 32 shows a selected component panel of a lintel, according to an embodiment of the present subject matter.

FIG. 32 shows a selected component panel of a lintel, according to an embodiment of the present subject matter. According to some embodiments, a front lintel 501 can concave towards the door so that the front wall surface is flush. As shown in this drawing, front lintel 501 can be louvered to allow air circulation and temperate control in the shed. A rear view of front lintel 501 is also included.

Figure 33:
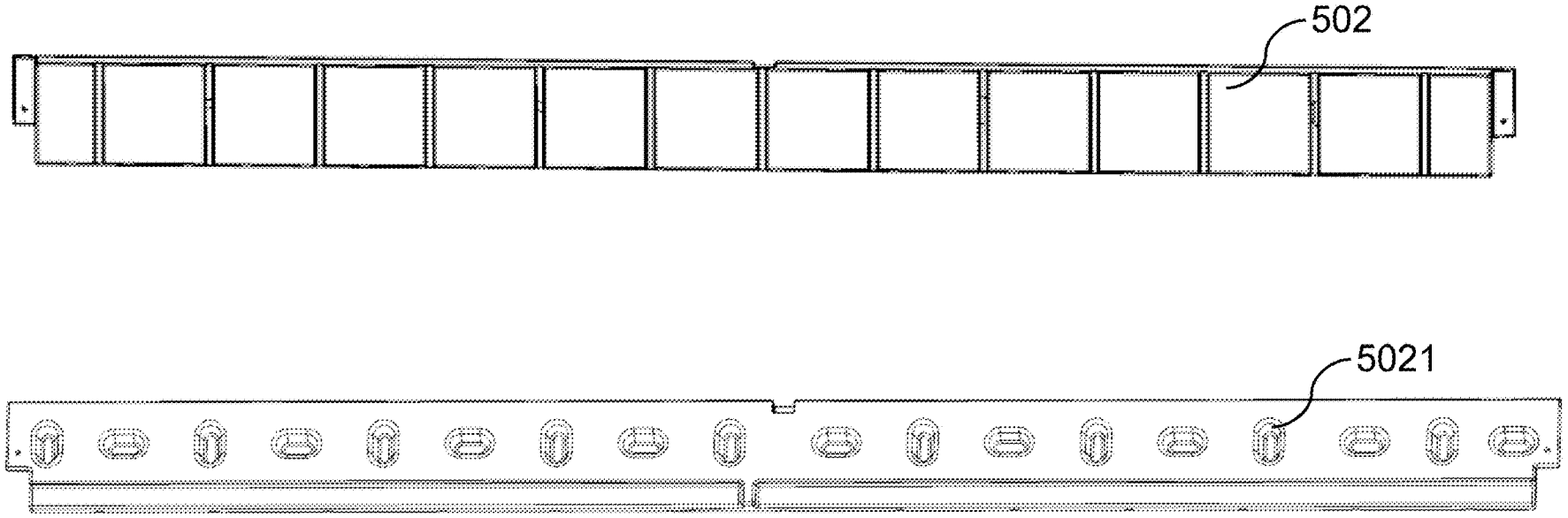
FIG. 33 shows another selected component panel of a lintel, according to an embodiment of the present subject matter.

FIG. 33 shows another selected component panel of a lintel, according to an embodiment of the present subject matter. According to some embodiments, a rear lintel 502 can constitute a rear side of the lintel. It can also include a folding groove if needed. A rear view 5021 of rear lintel 502 is also included in the drawing.

Figure 34:
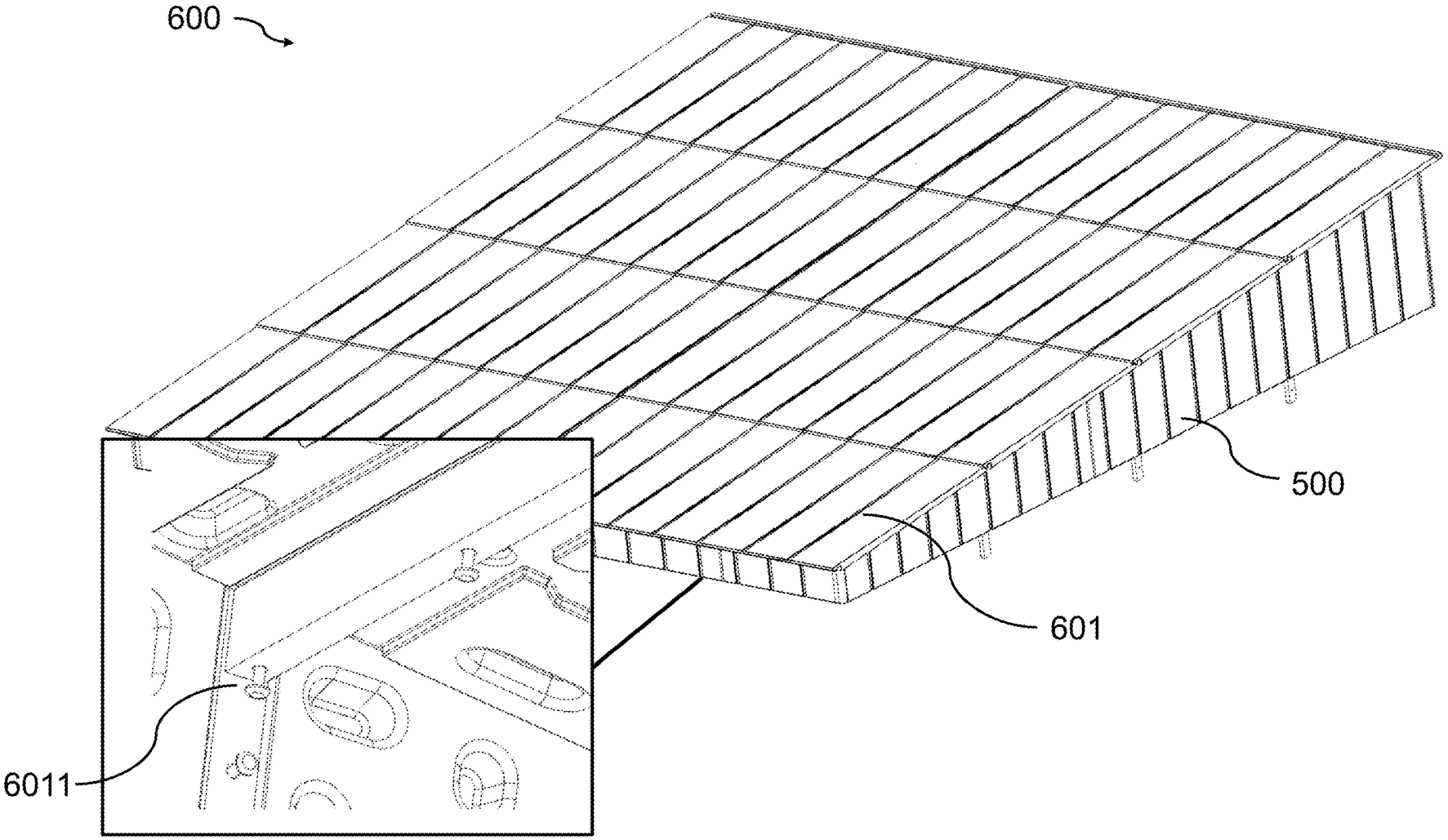
FIG. 34 shows a roof connected with a lintel for the outdoor storage shed, according to an embodiment of the present subject matter.

FIG. 34 shows a roof connected with a lintel for the outdoor storage shed, according to an embodiment of the present subject matter. According to some embodiments, a roof with lintel 600 can comprise a roof 601 that is fixed to lintel 500 via various connectors such as screws 6011.

Figure 35:
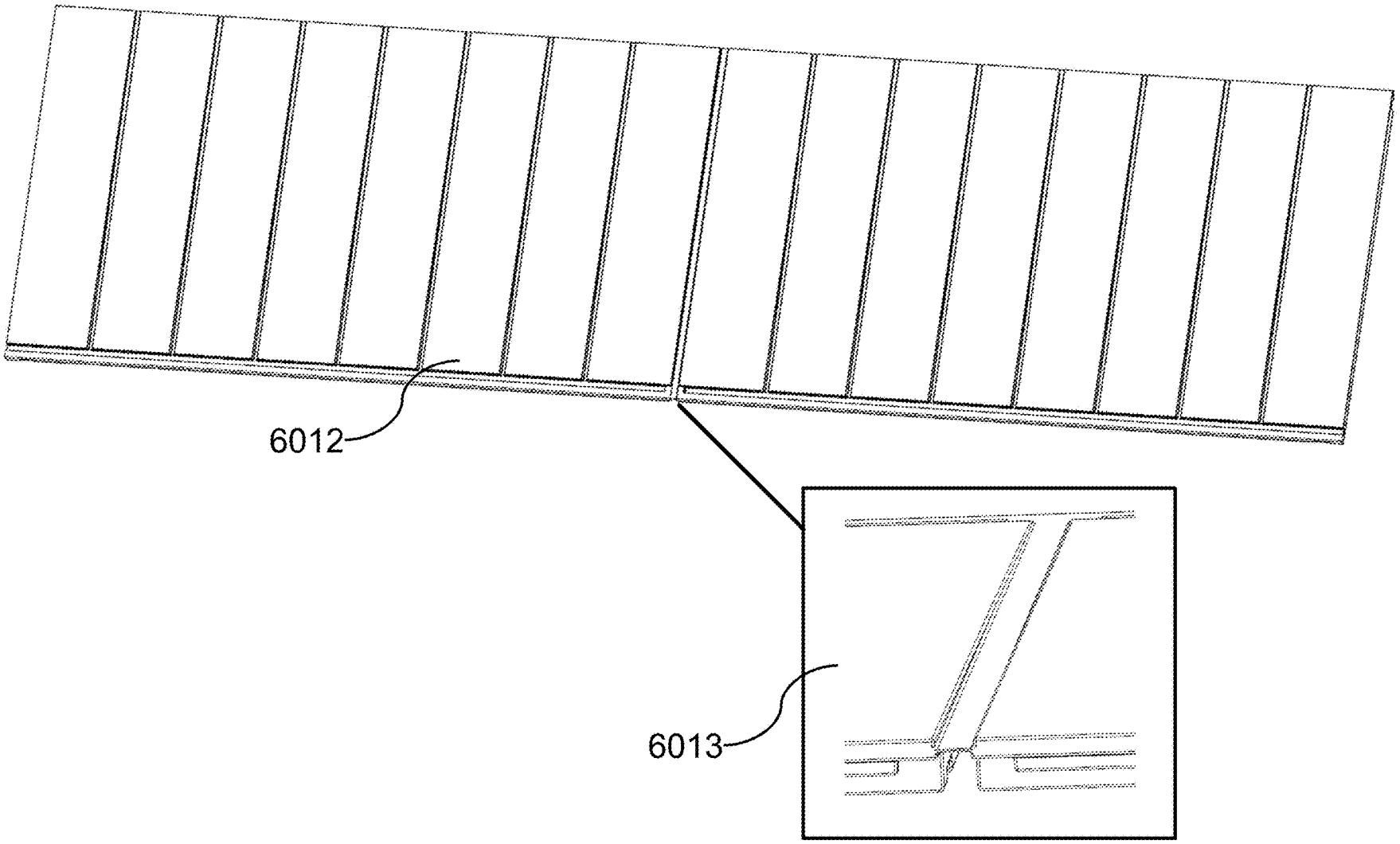
FIG. 35 shows a foldable roof panel for a roof, according to an embodiment of the present subject matter.

FIG. 35 shows a foldable roof panel for a roof, according to an embodiment of the present subject matter. According to some embodiments, a foldable roof panel 6012 can be utilized to reduce storage space and cost. As shown in the drawing, a folding groove 6013 can be manufactured by injecting less or thinner plastic than the rest of the roof panel. During transportation, foldable roof panel 6012 can be folded into half size or smaller size at folding groove 6013, which is similar sized with the other panels. During installation, foldable roof panel 6012 can unfold and form a flat surface.

Figure 36:
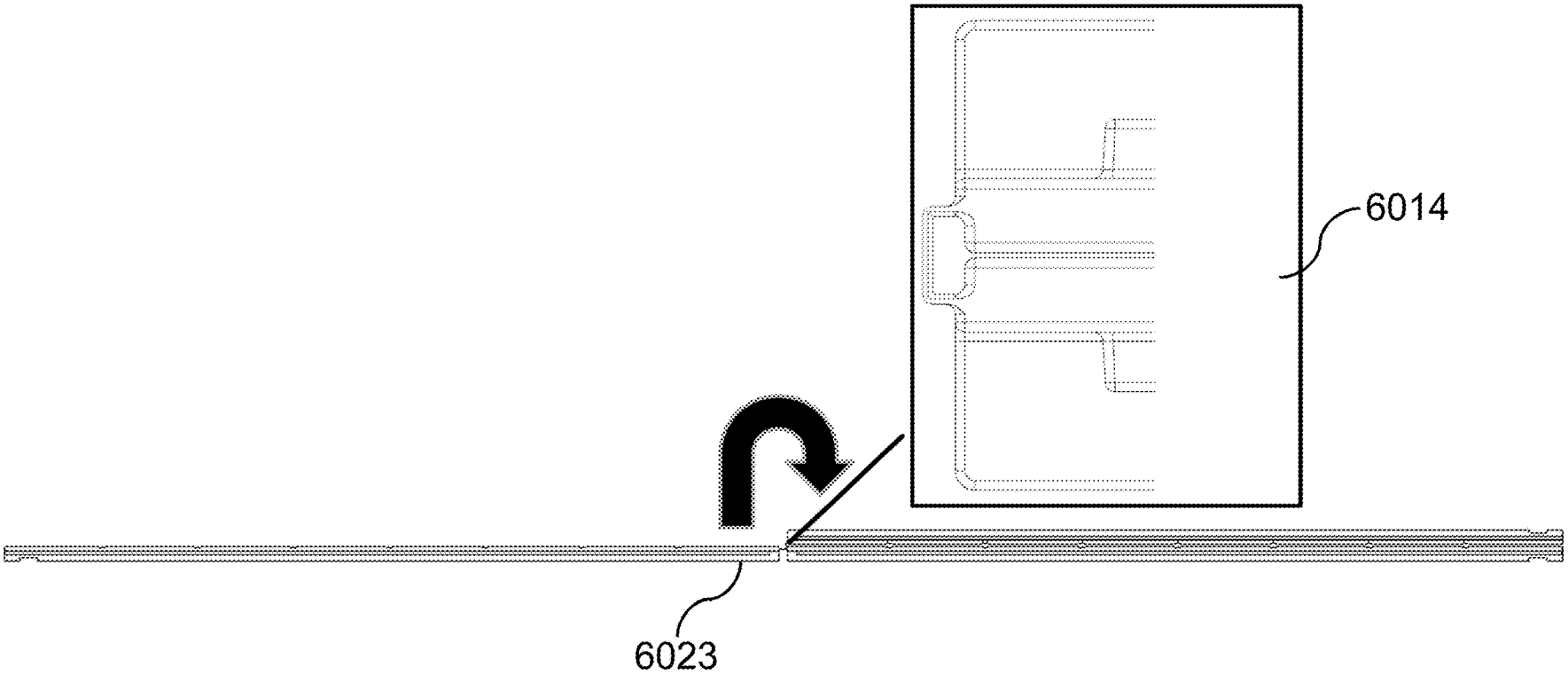
FIG. 36 shows a foldable roof panel, according to an embodiment of the present subject matter.

FIG. 36 shows a foldable roof panel, according to an embodiment of the present subject matter. According to some embodiments, in this side view 6023 and exploded view 6014, foldable roof panel 6012 can be folded to a 180° angle, thus reducing the package size to half of original size.

Figure 37:
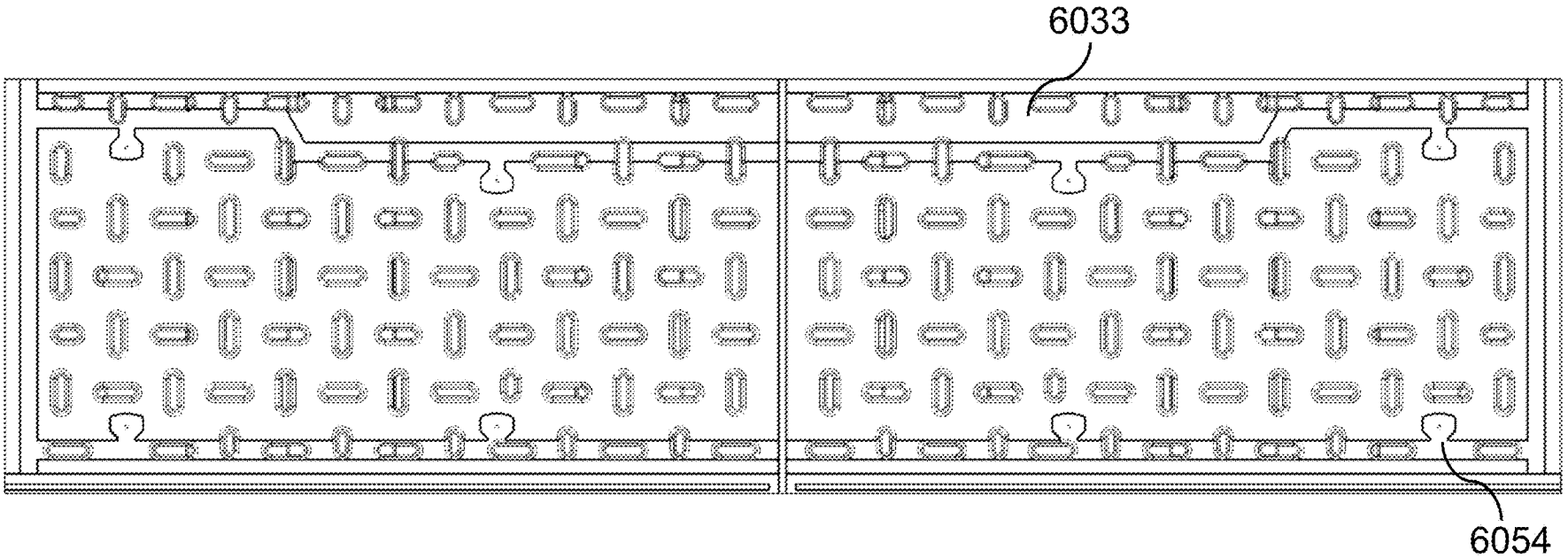
FIG. 37 shows a rear view of a foldable roof panel, according to an embodiment of the present subject matter.

FIG. 37 shows a rear view of a foldable roof panel, according to an embodiment of the present subject matter. According to some embodiments, a rear side of a foldable roof panel 6033 can project towards the corresponding portions at the lintel. Such protrusions can enable easier installation between the roof and the lintel. Also, it can prevent the roof to slip away from the lintel. Additional fixers 6054, such as screws and bots, can be adopted to secure the roof on top of the lintel.

Figure 38:
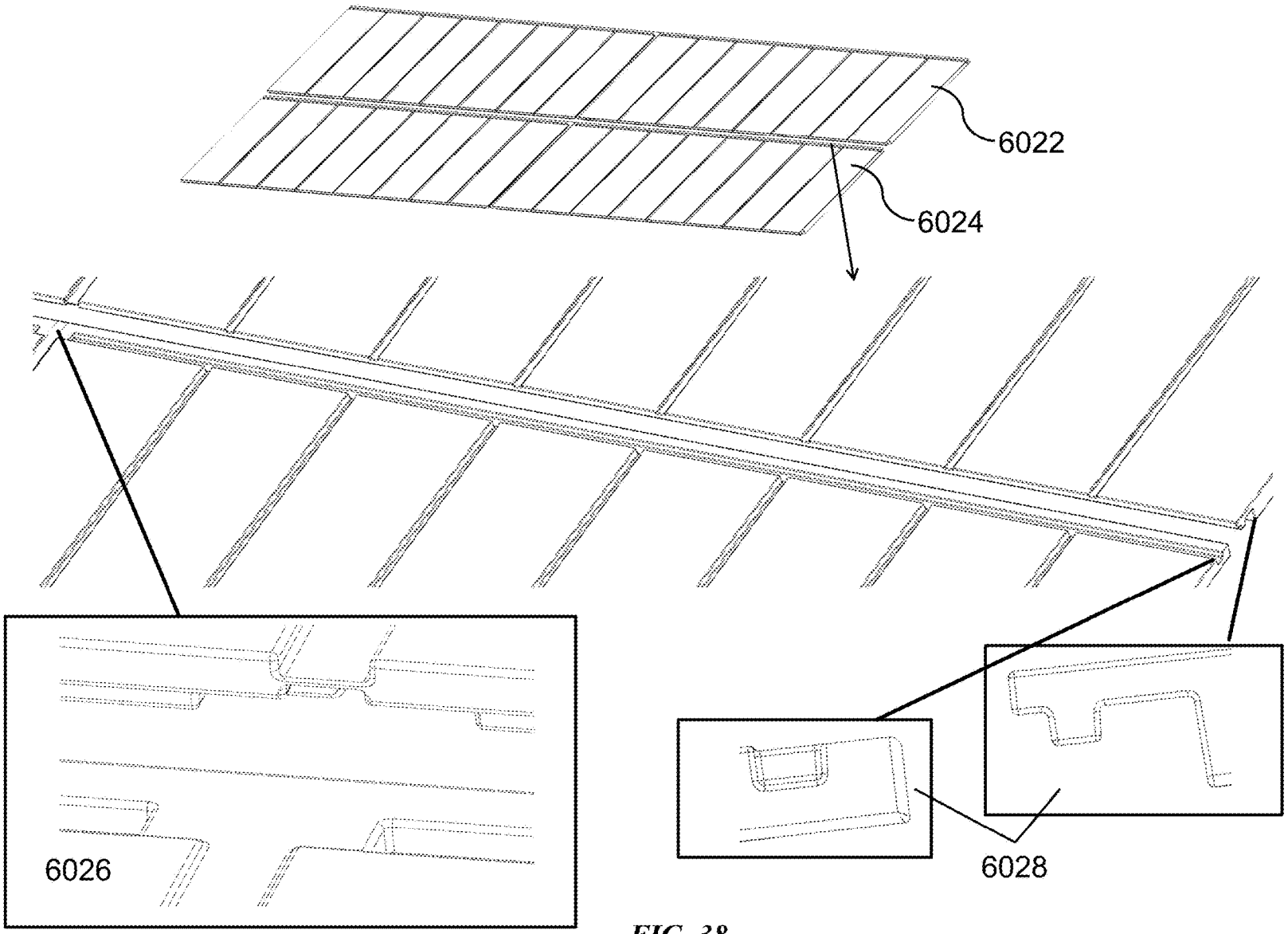
FIG. 38 shows a number of coupled roof panels, according to an embodiment of the present subject matter.

FIG. 38 shows a number of coupled roof panels, according to an embodiment of the present subject matter. According to some embodiments, a first roof panel 6022 can be connected to a second roof panel 6024 via integrated coupling 6028. For example, an embedded slot arranged on second roof panel 6024 can engage with a protruded portion arranged on first roof panel 6022 when the two panels are connected. Furthermore, as shown in this drawing, a water rail 6026 can be created between the panels so that water can be properly drained from the roof. Furthermore, the roof's size can be expanded or reduced by adjusting the connected roof panels.

Figure 39:
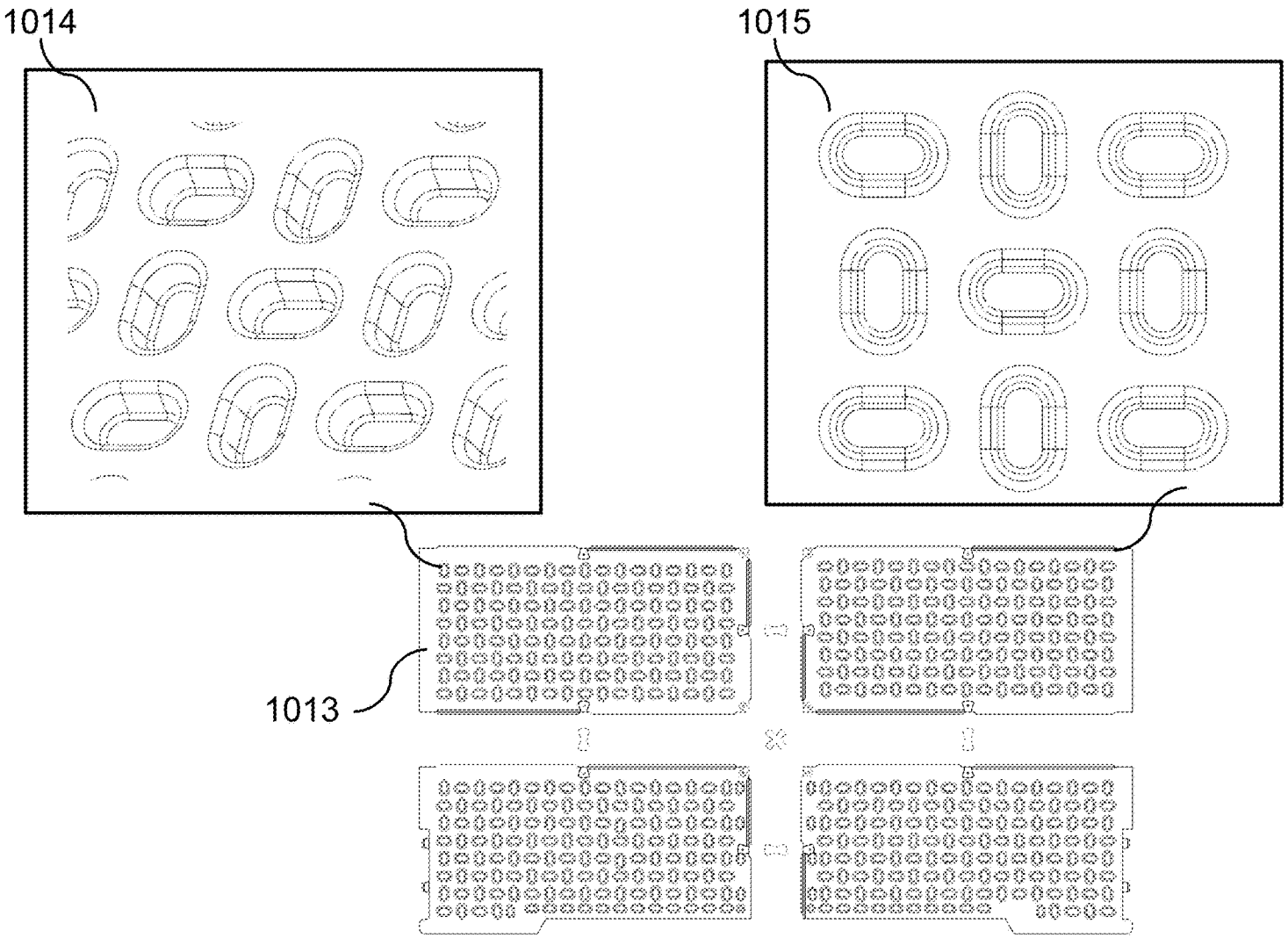
FIG. 39 shows back strengthening ribs of a molded plastic panel, according to an embodiment of the present subject matter.

FIG. 39 shows back strengthening ribs of a molded plastic panel, according to an embodiment of the present subject matter. FIG. 17 shows back strengthening ribs of a molded plastic panel, according to an embodiment of the present subject matter. A molded plastic panel can comprise a number of back strengthening ribs 1013 that comprise vertical support grooves and horizontal support grooves. A vertical or horizontal support groove can create an indent and touch point for the two layers of a molded plastic panel, which increase its durability and stability. In particular, each vertical support groove can be encircled by a plurality of horizontal support grooves. In addition, each horizontal support groove can be surrounded by a plurality of vertical support grooves. Such a balanced switch between the two orientations of the oval support grooves can maximize the intended benefits of the grooves. Furthermore, a side view 1014 of back strengthening ribs 1013 is displayed along with a top view 1015 of them.

According to some embodiments, the storage shed structure of the present subject matter can be an indoor shed. Furthermore, some or all features of the present subject matter can be incorporated into other types of molded plastic assembly.

The above are only the preferred embodiments of the present subject matter. It should be pointed out that for those of ordinary skill in the art, without departing from the principle of the present subject matter, various modifications or improvements can be made to the present subject matter, such as in other applications. For example, the disclosed features can be incorporated into other molded plastic furniture assemblies, or these features, when applicable, can be incorporated into non-molded plastic furniture assemblies, and these are all considered to be within the protection scope of the present subject matter.

It is to be understood that even though numerous characteristics and advantages of various embodiments of the present subject matter have been set forth in the foregoing description, together with details of the structure and function of various embodiments of the subject matter, this disclosure is illustrative only. In some cases, certain subassemblies are only described in detail with one such embodiment. Nevertheless, it is recognized and intended that such subassemblies may be used in other embodiments of the subject matter. Practitioners skilled in the art will recognize many modifications and variations. Changes may be made in detail, especially matters of structure and management of parts within the principles of the embodiments of the present subject matter to the full extent indicated by the broad general meaning of the terms in which the appended claims are expressed.

Having disclosed exemplary embodiments and the best mode, modifications and variations may be made to the disclosed embodiments while remaining within the scope of the embodiments of the subject matter as defined by the following claims.

What is claimed is:

1. A storage shed structure made of molded plastic panels, comprising:

a floor;

side walls coupled with the floor, the side walls further comprise:

a plurality of flat panels;

a plurality of foldable corner panels that form four corners of the storage shed structure, each foldable corner panel includes an embedded folding groove defined by a living hinge extending an entire length thereof, the embedded folding groove dividing each foldable corner panel into a first leaf and a second leaf, wherein the plurality of flat panels are coupled to the plurality of corner panels via at least one or more interlocked teeth couplings;

one or more doors coupled with the side walls and the floor; and a roof that comprises a plurality of roof panels.

2. The storage shed structure of claim 1, wherein the interlocked teeth couplings comprise a plurality of protrusions and matched recesses arranged on both the plurality of foldable corner panels and the plurality of flat panels, wherein plastic material thereof has a varied depth based on a design of the interlocked teeth couplings.

3. The storage shed structure of claim 1, wherein the molded plastic panels comprise a number of back strengthening ribs that comprise vertical support grooves and horizontal support grooves, and wherein each vertical support groove is surrounded by a plurality of horizontal support grooves.

4. The storage shed structure of claim 1, further comprising:

a concave door frame transition within a foldable corner panel, wherein the concave door frame is sloped towards a door.

5. The storage shed structure of claim 1, further comprising:

a plurality of supporting beams that are stored within embedded slots in a back portion of the molded plastic panels during transportation, wherein a depth of the embedded slots is smaller than a depth of the supporting beams.

6. The storage shed structure of claim 1, further comprising:

a plurality of shelf grooves embedded into interior surfaces of the foldable molded plastic panels.

7. The storage shed structure of claim 6, further comprising:

one or more shelves configured to insert into the plurality of shelf grooves to provide storage and to enhance stability of the storage shed structure.

8. The storage shed structure of claim 1, wherein the embedded folding groove enables the foldable corner panel to fold at a fixed angle when the foldable corner panel is installed.

9. The storage shed structure of claim 8, wherein the embedded folding groove is a first embedded folding groove and wherein each foldable corner panel further comprises:

a second embedded folding groove positioned within each foldable corner panel.

10. The storage shed structure of claim 8, further comprising:

a first coupling structure arranged on a first leaf;

a second coupling structure arranged on a second leaf, wherein the first coupling structure is different from the second coupling structure.

11. The storage shed structure of claim 10, wherein the first coupling structure comprises a slider and the second coupling structure comprises one or more clip slots.

12. A storage shed structure made of molded plastic panels, comprising:

a floor;

side walls coupled with the floor, the side walls further comprise:

a plurality of flat panels;

a plurality of corner panels that form four corners of the storage shed structure, each foldable corner panel includes an embedded folding groove defined by a living hinge extending an entire length thereof, the embedded folding groove dividing each foldable corner panel into a first leaf and a second leaf, wherein the plurality of flat panels are coupled to the plurality of corner panels via at least one or more interlocked teeth couplings; and a concave door frame transition within a respective said corner panel, wherein the concave door frame is sloped towards a door.

13. The storage shed structure of claim 1, wherein the interlocked teeth couplings comprise a plurality of protrusions and matched recesses arranged on both the plurality of foldable corner panels and the plurality of flat panels, wherein plastic material thereof has a varied depth based on a design of the interlocked teeth couplings.

14. The storage shed structure of claim 12, wherein the molded plastic panels comprise a number of back strengthening ribs that comprise vertical support grooves and horizontal support grooves, and wherein each vertical support groove is surrounded by a plurality of horizontal support grooves.

15. The storage shed structure of claim 12, further comprising:

a plurality of supporting beams that are stored within embedded slots in a back portion of the molded plastic panels during transportation, wherein a depth of the embedded slots is smaller than a depth of the supporting beams.

16. The storage shed structure of claim 12, further comprising:

a plurality of shelf grooves embedded into interior surfaces of the molded plastic panels.

17. The storage shed structure of claim 12, further comprising:

one or more shelves configured to insert into the plurality of shelf grooves to provide storage and to enhance stability of the storage shed structure.

18. A storage shed structure made of molded plastic panels, comprising:

a floor;

side walls coupled with the floor, the side walls further comprise:

a plurality of flat panels;

a plurality of foldable corner panels that form four corners of the storage shed structure;

a concave door frame transitions within a respective said foldable corner panel, wherein the concave door frame is sloped towards a door coupled with the side walls and a floor; and a roof that comprises a plurality of foldable roof panels, wherein each foldable corner panel and each foldable roof panel includes an embedded folding groove defined by a living hinge extending an entire length thereof, the embedded folding groove dividing each foldable panel into a first leaf and a second leaf.

19. The storage shed structure of claim 18, wherein the embedded folding groove enables each panel to fold at a fixed angle when the storage shed structure is installed.

* * * * *